US007845033B2

(12) United States Patent
DeBraal et al.

(10) Patent No.: US 7,845,033 B2
(45) Date of Patent: Dec. 7, 2010

(54) MEDICAL EXAMINATION TABLE

(75) Inventors: Jack A. DeBraal, Plymouth, WI (US); Michael J. Marchant, Franklin, WI (US); Mark E. Jensen, Sheboygan, WI (US); Michael Bargiel, Phoenix, AZ (US); Michael F. Hoft, Germantown, WI (US); Richard Walters, Hugo, MN (US)

(73) Assignee: The Brewer Company, LLC, Menomonee Falls, WI (US)

( * ) Notice: Subject to any disclaimer, the term of this patent is extended or adjusted under 35 U.S.C. 154(b) by 0 days.

(21) Appl. No.: 12/391,169

(22) Filed: Feb. 23, 2009

(65) Prior Publication Data

US 2009/0241263 A1 Oct. 1, 2009

Related U.S. Application Data

(63) Continuation of application No. 11/495,185, filed on Jul. 28, 2006, now Pat. No. 7,513,000.

(60) Provisional application No. 60/703,372, filed on Jul. 28, 2005.

(51) Int. Cl.
*A61G 15/06* (2006.01)
*A61G 15/00* (2006.01)

(52) U.S. Cl. ..... 5/611; 5/600; 5/613; 5/308; 5/662; 297/188.11; 297/344.15; 297/354.13; 297/411.31

(58) Field of Classification Search ..... 5/600, 5/611, 613, 617, 58, 308, 507.1, 662; 297/188.11, 297/344.15–344.17, 354.13, 411.31
See application file for complete search history.

(56) References Cited

U.S. PATENT DOCUMENTS

| | | | |
|---|---|---|---|
| 217,646 | A | 7/1879 | Sherer |
| 487,625 | A | 12/1892 | Kales |
| 488,649 | A | 12/1892 | Daggett |
| 542,060 | A | 7/1895 | Lentz |
| 1,039,708 | A | 10/1912 | Denquer |
| 1,650,327 | A | 11/1927 | Conrad |
| 1,684,889 | A | 9/1928 | Russ |
| 1,891,629 | A | 12/1932 | Van Wagner |
| 1,967,422 | A | 7/1934 | Nadelson |
| 2,120,732 | A | 6/1938 | Comper et al. |
| 2,267,973 | A | 12/1941 | Demcak |

(Continued)

OTHER PUBLICATIONS

Promotional materials for the "4040: Low Access Power Exam Table"; United Metal Fabricators Inc.; printed from website http://www.umf-exam.com; Oct. 6, 2006; 3 pages.

(Continued)

*Primary Examiner*—Michael Trettel
(74) *Attorney, Agent, or Firm*—Foley & Lardner LLP

(57) ABSTRACT

A medical examination table is provided. The medical examination table comprises a base providing a storage area, a patient support movable independent of the base between a lowered position and a raised position, and a lift mechanism coupled to the patient support for moving the patient support between the lowered position and the raised position. The patient support comprises a backrest and a seat. Movement of the patient support independent or separately from the base and without interfering with the storage areas within the base may allow for the efficient use of the examination table as a storage area.

20 Claims, 12 Drawing Sheets

U.S. PATENT DOCUMENTS

| | | | | |
|---|---|---|---|---|
| 2,272,819 | A | | 2/1942 | Poetsch et al. |
| 2,306,031 | A | | 12/1942 | Anderson et al. |
| 2,538,993 | A | | 1/1951 | Travis |
| 2,565,784 | A | | 8/1951 | Sheean |
| 2,605,151 | A | | 7/1952 | Shampaine |
| 2,606,801 | A | | 8/1952 | Shampaine |
| D170,305 | S | | 9/1953 | Claus |
| 2,652,887 | A | | 9/1953 | Fitzgerald |
| 2,659,902 | A | | 11/1953 | Fitzgerald et al. |
| 2,679,445 | A | | 5/1954 | Roehm |
| 2,682,671 | A | | 7/1954 | Faure |
| 2,788,529 | A | | 4/1957 | Moritzacky et al. |
| 2,801,142 | A | | 7/1957 | Adams |
| 2,941,215 | A | | 6/1960 | Johnson |
| 3,016,275 | A | | 1/1962 | Grant |
| 3,041,121 | A | | 6/1962 | Comper |
| 3,100,129 | A | | 8/1963 | Adolphson |
| D202,963 | S | | 11/1965 | Dailey |
| 3,215,834 | A | | 11/1965 | Tayman |
| 3,236,556 | A | * | 2/1966 | Lathers ..... 296/65.08 |
| D204,222 | S | | 3/1966 | Dailey |
| 3,281,141 | A | | 10/1966 | Smiley et al. |
| D207,081 | S | | 2/1967 | Katzfey et al. |
| D207,483 | S | | 4/1967 | Dottinger |
| 3,334,951 | A | | 8/1967 | Douglas, Jr. et al. |
| 3,348,893 | A | | 10/1967 | Katzfey et al. |
| 3,355,163 | A | | 11/1967 | Leinassar |
| 3,409,287 | A | | 11/1968 | Chervenka |
| 3,411,766 | A | | 11/1968 | Lanigan |
| 3,413,663 | A | | 12/1968 | Swann |
| 3,452,977 | A | | 7/1969 | Ryman |
| 3,499,529 | A | | 3/1970 | Katzfey et al. |
| 3,638,935 | A | | 2/1972 | Lelugas et al. |
| 3,658,317 | A | | 4/1972 | Bartlett et al. |
| 3,724,004 | A | | 4/1973 | Behrens |
| 3,754,749 | A | | 8/1973 | Lyon et al. |
| 3,814,414 | A | | 6/1974 | Chapa |
| 3,817,512 | A | | 6/1974 | Torrey |
| 3,851,870 | A | | 12/1974 | Cook |
| 3,866,973 | A | | 2/1975 | Heubeck |
| 3,868,103 | A | | 2/1975 | Pageot et al. |
| 3,905,591 | A | | 9/1975 | Schorr et al. |
| 3,944,205 | A | | 3/1976 | Mueller |
| 3,947,686 | A | | 3/1976 | Cooper et al. |
| 3,967,128 | A | | 6/1976 | Smulewicz |
| 3,997,792 | A | | 12/1976 | Conrad et al. |
| 4,003,704 | A | | 1/1977 | Zurolo et al. |
| 4,034,972 | A | | 7/1977 | Peterson |
| D245,287 | S | | 8/1977 | Damico et al. |
| 4,045,078 | A | | 8/1977 | Shine |
| 4,057,240 | A | | 11/1977 | Damico et al. |
| 4,076,230 | A | | 2/1978 | Pike |
| D250,043 | S | | 10/1978 | Shine |
| 4,148,472 | A | | 4/1979 | Rais et al. |
| 4,168,099 | A | | 9/1979 | Jacobs et al. |
| 4,180,002 | A | | 12/1979 | Huempfner |
| 4,183,596 | A | | 1/1980 | Greene et al. |
| 4,186,917 | A | | 2/1980 | Rais et al. |
| 4,221,371 | A | | 9/1980 | Kuphal |
| 4,284,268 | A | | 8/1981 | Gauthier |
| 4,287,422 | A | | 9/1981 | Kuphal et al. |
| 4,318,538 | A | | 3/1982 | Janssen |
| D263,777 | S | | 4/1982 | Thompson |
| 4,322,899 | A | | 4/1982 | Clune |
| D265,241 | S | | 6/1982 | Patterson |
| D265,242 | S | | 6/1982 | Patterson |
| D266,023 | S | | 8/1982 | McLachlan |
| D266,765 | S | | 11/1982 | Clune |
| 4,383,351 | A | | 5/1983 | Fenwick |
| 4,407,687 | A | | 10/1983 | Mitchell |
| 4,464,780 | A | | 8/1984 | Ruiz |
| 4,501,414 | A | | 2/1985 | Mason et al. |
| 4,506,872 | A | | 3/1985 | Westerberg et al. |
| 4,508,387 | A | | 4/1985 | Gilbert et al. |
| D278,668 | S | | 5/1985 | Simpkins |
| 4,516,805 | A | | 5/1985 | Leeper et al. |
| 4,529,185 | A | | 7/1985 | Gutierres |
| 4,540,165 | A | | 9/1985 | Green et al. |
| 4,545,628 | A | | 10/1985 | Richey |
| 4,547,092 | A | | 10/1985 | Vetter et al. |
| 4,552,403 | A | | 11/1985 | Yindra |
| 4,557,471 | A | | 12/1985 | Pazzini |
| 4,558,857 | A | | 12/1985 | Heller |
| D282,398 | S | | 1/1986 | Yindra |
| 4,586,398 | A | | 5/1986 | Yindra |
| 4,586,762 | A | | 5/1986 | Kennedy et al. |
| 4,589,124 | A | | 5/1986 | Ruiz |
| 4,589,642 | A | | 5/1986 | Schnelle et al. |
| 4,600,248 | A | | 7/1986 | Pflieger |
| 4,602,756 | A | | 7/1986 | Chatfield |
| 4,606,575 | A | | 8/1986 | Kodet |
| 4,608,812 | A | | 9/1986 | Willson |
| D286,481 | S | | 11/1986 | Case et al. |
| 4,653,129 | A | | 3/1987 | Kuck et al. |
| 4,665,574 | A | | 5/1987 | Filips et al. |
| 4,667,354 | A | | 5/1987 | Carey, Jr. et al. |
| 4,667,605 | A | | 5/1987 | Bastian |
| 4,691,393 | A | | 9/1987 | Kuck |
| 4,700,916 | A | | 10/1987 | Bastian et al. |
| 4,716,840 | A | | 1/1988 | Tringali et al. |
| 4,717,102 | A | | 1/1988 | Pflieger |
| 4,732,089 | A | | 3/1988 | Mueller |
| 4,732,430 | A | | 3/1988 | Byrns |
| 4,750,305 | A | | 6/1988 | Bastian |
| 4,752,977 | A | | 6/1988 | Smith et al. |
| 4,761,000 | A | | 8/1988 | Fisher et al. |
| D297,597 | S | | 9/1988 | Simpkins et al. |
| 4,796,846 | A | | 1/1989 | Meier et al. |
| 4,805,365 | A | | 2/1989 | Bastian |
| D300,657 | S | | 4/1989 | Simpkins et al. |
| 4,819,569 | A | | 4/1989 | Bastian et al. |
| 4,821,350 | A | | 4/1989 | Feldt |
| D300,997 | S | | 5/1989 | Simpkins et al. |
| 4,826,117 | A | | 5/1989 | Bastian et al. |
| 4,826,221 | A | | 5/1989 | Harmon |
| D301,925 | S | | 6/1989 | Simpkins et al. |
| 4,846,431 | A | | 7/1989 | Pflieger |
| 4,852,941 | A | | 8/1989 | Jones |
| 4,858,260 | A | | 8/1989 | Failor et al. |
| 4,865,303 | A | | 9/1989 | Hall |
| 4,872,656 | A | | 10/1989 | Brendgord et al. |
| 4,872,657 | A | | 10/1989 | Lussi |
| 4,894,876 | A | | 1/1990 | Fenwick |
| 4,905,266 | A | | 2/1990 | Kuck et al. |
| 4,913,413 | A | | 4/1990 | Raab |
| 4,916,725 | A | | 4/1990 | Quinter et al. |
| 4,937,902 | A | | 7/1990 | Shapiro |
| 4,956,592 | A | | 9/1990 | Schulte et al. |
| 4,958,816 | A | | 9/1990 | Chaney et al. |
| 4,961,610 | A | | 10/1990 | Reeder et al. |
| 4,966,351 | A | | 10/1990 | Klepacki |
| 4,968,013 | A | | 11/1990 | Kuck |
| 4,973,034 | A | | 11/1990 | Michele |
| 4,989,848 | A | | 2/1991 | Monroe |
| 4,995,067 | A | | 2/1991 | Royster et al. |
| 4,996,731 | A | | 3/1991 | Kruyt |
| 5,005,667 | A | | 4/1991 | Anderson |
| 5,016,268 | A | | 5/1991 | Lotman |
| D319,158 | S | | 8/1991 | Jones et al. |
| 5,037,053 | A | | 8/1991 | Fox et al. |
| D321,097 | S | | 10/1991 | Jones et al. |
| 5,078,349 | A | | 1/1992 | Smith |
| 5,081,808 | A | | 1/1992 | Bastian et al. |
| 5,084,927 | A | | 2/1992 | Parkevich |

D326,381 S 5/1992 Heiligenthal et al.
5,157,787 A 10/1992 Donnellan et al.
D330,771 S 11/1992 Chaney et al.
D330,813 S 11/1992 Spitzer et al.
5,166,968 A 11/1992 Morse
5,203,135 A 4/1993 Bastian
D335,409 S 5/1993 Kellems
5,208,928 A 5/1993 Kuck et al.
5,223,229 A 6/1993 Brucker
5,231,719 A 8/1993 Schnelle
D341,737 S 11/1993 Shepherd
5,269,326 A 12/1993 Verrier
5,279,011 A 1/1994 Schnelle
D344,802 S 3/1994 Kuck et al.
D345,266 S 3/1994 Koguma
5,329,657 A 7/1994 Bartley et al.
5,339,750 A 8/1994 Smies
5,345,632 A 9/1994 Langenaeken et al.
5,348,375 A 9/1994 Steininger
5,369,825 A 12/1994 Reesby
5,369,827 A 12/1994 Parke et al.
5,403,549 A 4/1995 McNeil et al.
5,426,795 A 6/1995 Harty
D361,438 S 8/1995 Spencer et al.
D365,224 S 12/1995 Pohlman
5,472,270 A 12/1995 Czarnecky et al.
5,496,105 A 3/1996 Czarnecky et al.
5,507,050 A 4/1996 Welner
D370,572 S 6/1996 Lin
5,528,782 A 6/1996 Pfeuffer et al.
5,538,215 A 7/1996 Hosey
5,564,662 A 10/1996 Lussi et al.
5,564,663 A 10/1996 Cook et al.
5,565,834 A 10/1996 Hanley et al.
5,568,209 A 10/1996 Priester et al.
5,568,817 A 10/1996 Harty
D378,961 S 4/1997 Nordstrom et al.
D379,409 S 5/1997 Schwaegerle et al.
5,628,078 A 5/1997 Pennington et al.
5,638,644 A 6/1997 Bastian
5,645,313 A 7/1997 Best et al.
5,655,238 A 8/1997 Stickley et al.
5,660,405 A 8/1997 Campbell
5,661,859 A 9/1997 Schaefer
5,678,267 A 10/1997 Kinder
5,680,957 A 10/1997 Liu
D386,634 S 11/1997 Daugs
5,689,999 A 11/1997 Wiley et al.
5,706,678 A 1/1998 Sasaki
5,754,997 A 5/1998 Lussi et al.
5,771,513 A 6/1998 Kirchgeorg et al.
5,781,943 A 7/1998 Moenning et al.
5,790,997 A 8/1998 Ruehl
5,855,207 A 1/1999 Moenning et al.
5,860,899 A 1/1999 Rassman
D404,945 S 2/1999 Simpkins et al.
D408,537 S 4/1999 Stickley et al.
D408,538 S 4/1999 Simpkins et al.
D408,539 S 4/1999 Simpkins
5,913,773 A 6/1999 Cox
5,919,131 A 7/1999 Smoler et al.
5,924,960 A 7/1999 Cohen
5,926,876 A 7/1999 Haigh et al.
5,953,773 A 9/1999 Asada et al.
D417,098 S 11/1999 Teufel et al.
D417,571 S 12/1999 Teufel et al.
D418,225 S 12/1999 Simpkins et al.
D420,225 S 2/2000 Lamb et al.
6,023,800 A 2/2000 Stickley
6,038,718 A 3/2000 Pennington et al.
6,073,284 A 6/2000 Borders
D428,629 S 7/2000 Cohen
6,089,593 A 7/2000 Hanson et al.
6,101,652 A 8/2000 Matern, Jr.
6,106,065 A 8/2000 Carroll
6,115,978 A 9/2000 Bastian et al.
6,131,214 A 10/2000 Moenning et al.
6,173,461 B1 1/2001 Alexander
6,202,230 B1 3/2001 Borders
6,209,463 B1 4/2001 Koharchik et al.
6,212,713 B1 4/2001 Kuck et al.
6,230,343 B1 5/2001 Buiskool et al.
6,237,172 B1 5/2001 Morgan, Sr.
6,240,579 B1 6/2001 Hanson et al.
6,256,812 B1 7/2001 Bartow et al.
6,264,006 B1 7/2001 Hanson et al.
6,276,012 B2 8/2001 Borders
6,289,537 B1 9/2001 Hopper et al.
6,295,671 B1 10/2001 Reesby et al.
6,345,193 B2 2/2002 Dutto et al.
6,351,678 B1 2/2002 Borders
6,353,949 B1 3/2002 Falbo
6,363,555 B1 4/2002 LaRose
6,374,133 B1 4/2002 Dutto et al.
D457,239 S 5/2002 Kunik
6,382,725 B1 5/2002 Carroll
D458,780 S 6/2002 Siepmann et al.
D461,899 S 8/2002 Siepmann et al.
D461,900 S 8/2002 Siepmann et al.
D462,189 S 9/2002 Brockway et al.
D462,445 S 9/2002 Barde et al.
D462,674 S 9/2002 Siepmann et al.
D463,861 S 10/2002 Siepmann et al.
6,505,364 B2 1/2003 Simmons et al.
D473,312 S 4/2003 Cook
6,546,577 B1 4/2003 Chinn
6,550,084 B2 4/2003 Siepmann et al.
6,568,008 B2 5/2003 Siepmann et al.
6,638,299 B2 10/2003 Cox
6,651,279 B1 11/2003 Muthuvelan
6,659,556 B2 12/2003 Pellerin
6,678,908 B2 1/2004 Borders et al.
6,681,423 B2 1/2004 Zachrisson
6,739,006 B2 5/2004 Borders et al.
6,754,923 B2 6/2004 Borders et al.
6,769,145 B1 8/2004 Pfeuffer et al.
D496,462 S 9/2004 Walters et al.
6,802,564 B2 10/2004 Brockway et al.
6,832,398 B2 12/2004 Borders et al.
6,843,182 B2 1/2005 Torcheboeuf
6,857,147 B2 2/2005 Somasundaram
6,874,182 B2 4/2005 L'Hegarat et al.
6,886,199 B1 5/2005 Schwaegerle
6,886,200 B2 5/2005 Blyshak et al.
7,150,058 B2 12/2006 Rabska et al.
7,376,991 B2 5/2008 Stewart et al.
7,513,000 B2 4/2009 DeBraal et al.
7,640,608 B2 * 1/2010 Smith et al. ..... 5/617
2001/0000363 A1 4/2001 Borders
2001/0003789 A1 6/2001 Dutto et al.
2002/0000008 A1 1/2002 Borders
2002/0170115 A1 11/2002 Borders et al.
2002/0170116 A1 11/2002 Borders et al.
2003/0061662 A1 4/2003 Strobel et al.
2003/0071503 A1 4/2003 Brockway et al.
2003/0074735 A1 4/2003 Zachrisson
2003/0145383 A1 8/2003 Schwaegerle
2004/0068797 A1 4/2004 Smith et al.
2004/0074002 A1 4/2004 Bannister
2004/0074003 A1 4/2004 Bannister
2004/0083549 A1 5/2004 L'Hegarat et al.
2004/0098804 A1 5/2004 Varadharajulu et al.
2004/0133979 A1 7/2004 Newkirk et al.
2004/0143904 A1 7/2004 Borders et al.
2004/0148703 A1 8/2004 Doering et al.
2004/0172756 A1 9/2004 Somasundaram

| | | | | |
|---|---|---|---|---|
| 2004/0172757 | A1 | 9/2004 | Somasundaram | |
| 2004/0261176 | A1 | 12/2004 | Plannerer | |
| 2004/0261178 | A1 | 12/2004 | Gnoyke | |
| 2005/0015878 | A1 | 1/2005 | Bannister et al. | |
| 2005/0077850 | A1 | 4/2005 | Treon | |
| 2005/0077852 | A1 | 4/2005 | Treon | |
| 2005/0077861 | A1 | 4/2005 | Treon | |
| 2005/0081294 | A1 | 4/2005 | Wolters | |
| 2005/0097675 | A1 | 5/2005 | Borders et al. | |
| 2007/0056103 | A1 * | 3/2007 | Magoteaux et al. | 5/600 |
| 2007/0061971 | A1 | 3/2007 | DeBraal et al. | |

OTHER PUBLICATIONS

Promotional materials for the "4070: Low Access Power Exam Table"; United Metal Fabricators Inc.; printed from website http://www.umf-exam.com; Oct. 6, 2006; 3 pages.

Promotional materials for the "222, 223, 622 and 623" power examination tables; Midmark Corp.; printed from website http://www.midmark.com; Oct. 6, 2006; 8 pages.

Promotional materials for the "Model 4430 and 4435" examination tables; Hausmann Industries, Inc.; printed from website http://www.hausmann.com/medmain; Oct. 6, 2006; 1 page.

Promotional materials for the "Model 4440 and 4445" examination tables; Hausmann Industries, Inc.; printed from website http://www.hausmann.com/medmain; Oct. 6, 2006; 1 page.

Promotional materials for the "Model 4460 and 4465" examination tables; Hausmann Industries, Inc.; printed from website http://www.hausmann.com/medmain; Oct. 6, 2006; 1 page.

Examination Table, Model 4430, printed from website www.hausmann.com/Model_4430.html on Feb. 26, 2004, 1 page.

Powermatic® Examination Table, Model 4460, printed from website www.hausmann.com/Model_4460.html on Feb. 26, 2004, 1 page.

Powermatic® Examination Table, Model 4400, printed from website www.hausmann.com/Model_4440.html on Feb. 26, 2004, 1 page.

Midmark, News Release titled "New Midmark Supply Assistant™ Storage Unit for Barrier-Free™ Exam Tables Provides Extra Storage at the Point of Care", 2 pages.

MIDMARK, Midmark 623 with Supply Assistant, 1 page.

MIDMARK, Midmark 623 Barrier-Free Power Examination Table, 2 pages.

Image printed from Internet address: http://www.tracomedical.com/images/products/midmark_413.jpg, printed on Jun. 3, 2009.

* cited by examiner

MEDICAL EXAMINATION TABLE

CROSS-REFERENCE TO RELATED PATENT APPLICATIONS

This application is a continuation of U.S. application Ser. No. 11/495,185 filed Jul. 28, 2006, now U.S. Pat. No. 7,513,000, which claims the benefit under 35 U.S.C. §119(e) of U.S. Provisional Application No. 60/703,372, having a filing date of Jul. 28, 2005, titled "Medical Examination Table," both of which are hereby incorporated by reference in their entireties.

BACKGROUND

The present application relates to medical examination tables and, more specifically, to medical examination tables that are designed for optimizing access to a patient supported on the medical examination table and also for optimizing the storage area near the medical examination table.

Utilizing space within work areas is an area of importance in designing equipment and devices. Specifically, in the current medical environment, the arrangement of equipment and supplies within an examination room is essential. Because of the need to streamline medical processes and, also, to limit the costs of medical equipment, there is a push for more compact equipment, including examination tables. Likewise, it has become more and more common for a single examination room to be used for different stages of a medical examination. For instance it would be advantageous for a single examination room to be used for an entire procedure, in a manner that is efficient and comfortable for the patient. The initial review, where a patient is typically sitting in a chair, and further examinations, where a patient may have to lie upon a flat surface, preferably will happen in the same room, thereby necessitating the need to store equipment and devices for both procedures within the same examining room. Thus, it would be advantageous to store the necessary equipment in an easily accessible area within the examining room.

For instance, examination tables that have added storage areas as part of the table have advantages over tables that do not have such arrangements. Current tables still can be improved, particularly in providing access to all storage areas on the examination table during all examination steps. Accordingly, there is a need for an examination table having a storage area that is easily accessible, regardless of the position of the table within the examination room, or the specific position and arrangement of the table. There is also a need for an examination table having a storage area that is accessible whether the examination table is in a seat-like or bed-like arrangement, or in a normal or reclined position.

Along with providing compact and more useful medical examination tables, the tables should still be rigid and sturdy enough so that they can be adequately used by a wide range of patients in a safe manner. For instance, increasing storage area on the table, or increasing work area for the doctor, in a manner that diminishes the amount of weight the table may support or the range that the table may move, does not necessarily result in a better table. Accordingly, there is a need for an examination table that efficiently utilizes the area of an examination room, while still providing a sturdy table covering a wide range of movements and positions.

Accordingly, it would be desirable to provide a medical examination table providing any one or more of the above mentioned needs or any other needs.

SUMMARY

One embodiment of the present application relates to a medical examination table assembly comprising a base providing a storage area, a patient support movable independent of the base between a lowered position and a raised position, and a lift mechanism coupled to the patient support for moving the patient support between the lowered position and the raised position. The patient support comprises a backrest and a seat. A seating surface of the seat is at a wheelchair accessible height when the patient support is moved to the lowered position.

Another embodiment of the present application relates to a medical examination table comprising a base having a surface, a patient support coupled to the base and a lift mechanism extending from a plane defined by the surface to the patient support. The patient support has a backrest and a seat. The seat having a seating surface extending along a plane and a rear edge supported forward of the surface when in a lowered position. The lift mechanism is configured to move the seat between the lowered position and a raised position. The lift mechanism lifts the seat while keeping the plane substantially fixed through at least a portion of a range of movement of the seat between the lowered position and the raised position.

Another embodiment of the present application relates to a medical examination table comprising a first base providing a first storage area, a second base positioned forward of the first storage area and providing a second storage area, a lift mechanism coupled to the second base and configured to move the second base between a lowered position and a raised position, and a patient support supported at the second base. The second base is movable independent of the first base between the raised position and the lowered position.

Another embodiment of the present application relates to a medical examination table comprising a first base providing a storage area and a patient support coupled to the first base. The patient support includes a backrest and a seat bottom. The backrest is movable relative to the seat bottom between a substantially upright position and a substantially horizontal position. The seat bottom is movable relative to the first base between a lowered position and a raised position. The backrest is substantially forward of the storage area when in the substantially upright position and substantially above the storage area when in the substantially horizontal position.

DETAILED DESCRIPTION

Referring generally to the FIGURES, a examination table and components thereof are shown according to exemplary embodiments. The examination table, shown as a medical examination table 10, utilizes the space in and around the table in an effective and efficient manner for storage and/or support of various articles (e.g., supplies, equipment, instrumentation, components, etc.) while providing a table that is suitable for use in a number of different procedures or applications (e.g., examinations, surgical procedures, etc.). The table 10 generally comprises a patient support 30 that is selectively movable (e.g., configurable, reconfigurable, adaptable, adjustable, etc.) between a range of positions. The table 10 further comprises a first base 33 and a lift mechanism (shown as a linkage system 12). The first base 33 supports or otherwise assists in stabilizing the patient support 30, while the lift mechanism is configured to selectively move the patient support 30 between a range positions.

Figure 1:
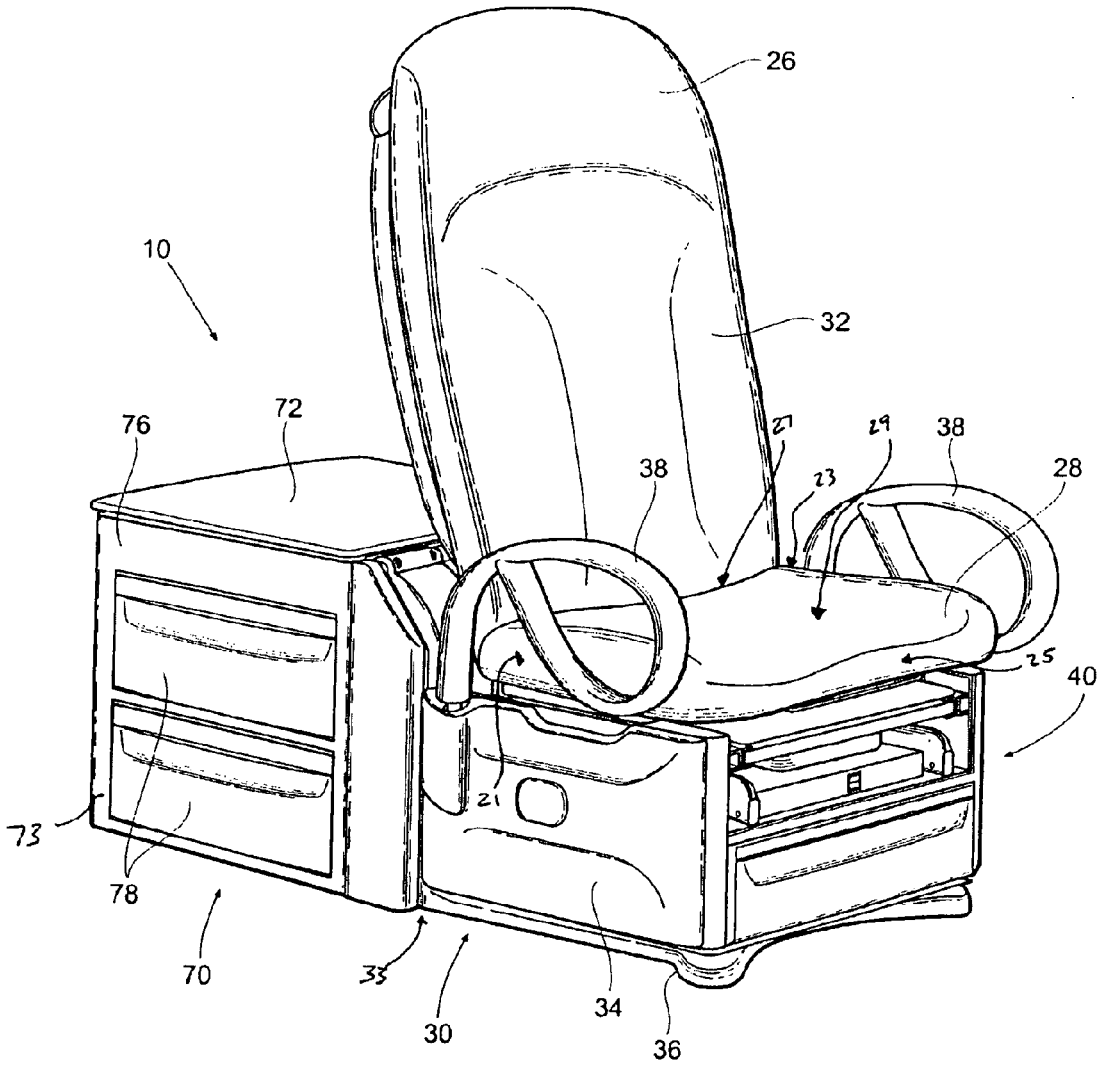
FIG. 1 is a perspective view of a medical examination table according to an exemplary embodiment.
Figure 2:
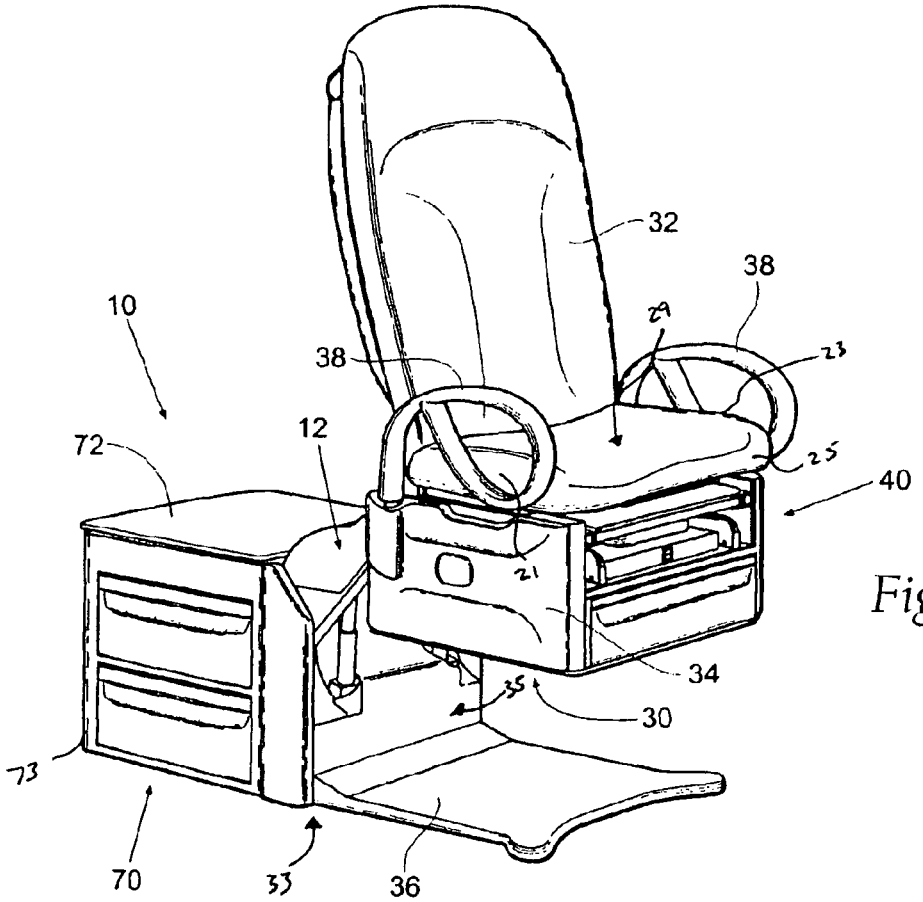
FIG. 2 is a perspective view of the medical examination table of FIG. 1 in an elevated position acting as an examination chair.

The patient support 30 moves independent or separate of the first base 33 between a lowered position (e.g., retracted position, wheelchair accessible position, etc.), shown in FIG. 1, and a raised position (e.g., elevated position, examination position, etc.), shown in FIG. 2, and may also be configured to move independent or separate of the first base 33 between a substantially upright position (e.g., seated position, vertical position, partially reclined position, etc.), shown in FIG. 2, to function as a chair and a substantially horizontal position (e.g., table position, fully reclined position, etc.) to function as a bed.

According to an exemplary embodiment, a structure (e.g., housing, body, storage compartment, storage pod, module, etc.), shown as a rear storage section 70, is provided closely adjacent or otherwise coupled to the first base 33. The storage section 70 provides a storage area suitable for supporting one or more articles related to the medical procedure (e.g., supplies, equipment, instrumentation, etc.) or other items that may be beneficial to store in an examination table. Similar to the first base 33, the movement of the patient support 30 is independent or separate of the storage section 70. For example, the first base 33 may be configured to rest upon a ground surface without moving during the operation of the table 10.

Before discussing the details of the table 10 and components thereof, it should be noted at the outset that references to "front," "back," "rear," "upper," "lower," "right," and "left" in this description are merely used to identify the various elements as they are oriented in the FIGURES, with "front," "back," and "rear" being relative to a patient seated in the patient support 30. These terms are not meant to limit the element which they describe, as the various elements may be oriented differently in various applications.

It should further be noted that for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 3:
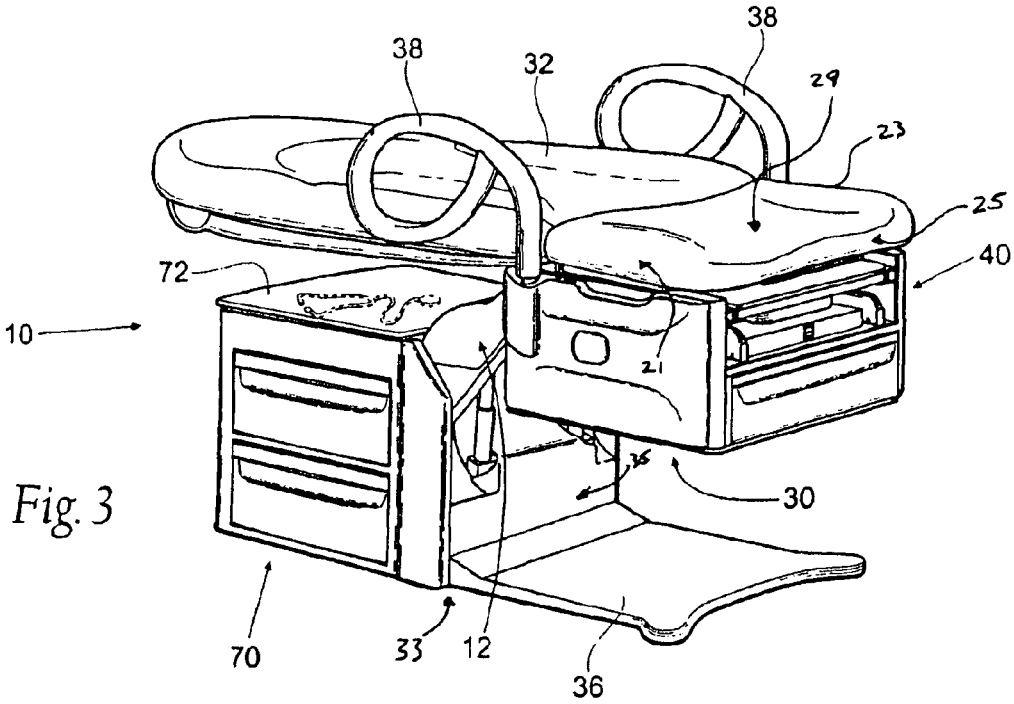
FIG. 3 is a perspective view of the medical examination table of FIG. 1 in an elevated position acting as an examination table.

Referring initially to FIGS. 1 through 3, the patient support 30 is shown as generally including a patient support structure 32 (e.g., patient support surface, table, chair, bed, etc.) and a second base 34 (e.g., body, support structure, housing, platform, storage compartment, etc.). According to the embodiment illustrated, the patient support structure 32 includes a backrest, shown as a seat back 26, and a seat, shown as a seat bottom 28. The seat back 26 is configured to support the back, neck and/or head of a typical patient, while the seat bottom 28 is sized and dimensioned to support the buttock and/or upper leg of a typical patient. The seat bottom 28 is at least partially defined by a first lateral side, shown as a right side 21, a second lateral side, shown as a left side 23, a front portion 25 (e.g., region, edge, periphery, etc.), a rear portion 27, and a seating surface 29.

The seat back 26 is shown as being a separate from the seat bottom 28. According to various alternative embodiments, the seat back 26 may be integrally formed with the seat bottom 28 to provide a single unitary body. According to still further alternative embodiments, the patient support 30 may be divided into sections other than a seat back portion and a seat portion. For example, the patient support 30 may include a section specifically designed to support the head and/or neck of a patient (e.g., a headrest, etc.) or a section specially designed to support the lower leg or foot of a patient (e.g., a footrest, etc.).

As stated above, the patient support 30 moves between a lowered position and a raised position. According to an exemplary embodiment, when the patient support 30 is moved to the lowered position, the seating surface 29 of that seat bottom 28 is at a height that allows for the efficient and relatively easy transfer of a patient in a wheelchair to the seating surface 29 and the return transfer of the patient from the seating surface 29 to the wheelchair. For purposes of the present application, such a height is referred to broadly as a wheelchair accessible height.

The wheelchair accessible height is a height at which the seating surface 29 of the seat bottom 28 is substantially coplanar with a seating surface of a typical wheelchair (or slightly above or below depending on whether the patient is entering or exiting the patient support 30). At this height a patient can be readily slid from one seating surface to the other. What constitutes a wheelchair accessible height will vary depending on the size of the wheelchair. According to an exemplary embodiment, the seating surface 29 of the seat bottom 28 is at least lowerable to a height that is approximately 24 inches above the ground. According to another exemplary embodiment, the seating surface 29 of the seat bottom 28 is at least lowerable to a height that is approximately 18 inches above the ground. According to various alternative embodiments, it may be beneficial to have the seating surface 29 of the seat bottom 28 lowerable to heights above and/or below those heights provided above to accommodate a particular wheelchair.

While the wheelchair accessible height has been defined above with reference to accommodating the transfer of a wheelchair bound patient to and from the patient support 30, such a height may also benefit a non-wheelchair patient attempting to enter or exit the patient support 30. For example, the wheelchair accessible height may assist an elderly patient, an obese patient, or any other patient who may otherwise have a mobility deficiency making it difficult to enter or exit the patient support 30. Lowering the seating surface 29 to a wheelchair accessible height advantageously reduces the likelihood that a separate foot step will need to be used by such patients when exiting or entering the patient support 30.

The patient support 30 is also movable to a raised position. When the patient support 30 is in the raised position, the seating surface 29 of that seat bottom 28 is at a height that allows for the effective examination of a patient by the examiner or caregiver. For purposes of the present application, such a height is referred to broadly as an examination height. According to an exemplary embodiment, the seating surface 29 of the seat bottom 28 can be raised to at least a height that is approximately 30 inches above a ground surface. According to another exemplary embodiment, the seating surface 29 of the seat bottom 28 can be raised to at least a height that is approximately 37 inches above a ground surface. According to various alternative embodiments, it may be beneficial to allow the seating surface 29 of the seat bottom 28 to be raised to a maximum height that is above and/or below those heights provided above.

According to an exemplary embodiment, the seat back 26 is pivotally supported relative to the seat bottom 28 thereby allowing the inclination or angle of the seat back 26 to be selectively adjusted relative to the seat bottom 28. The seat back 26 can be configured to move between any of a number of ranges relative to the seat bottom 28 depending on various design criteria. According to the embodiment illustrated, the seat back 26 is configured to rotate relative to the seat bottom 28 between a substantially upright position, shown in FIGS. 1 and 2, and a substantially horizontal position, shown in FIG. 3. The rear edge 27 of the seat bottom 28 substantially represents the axis at which the seat back 26 rotates relative to the seat bottom 28.

Figure 5:
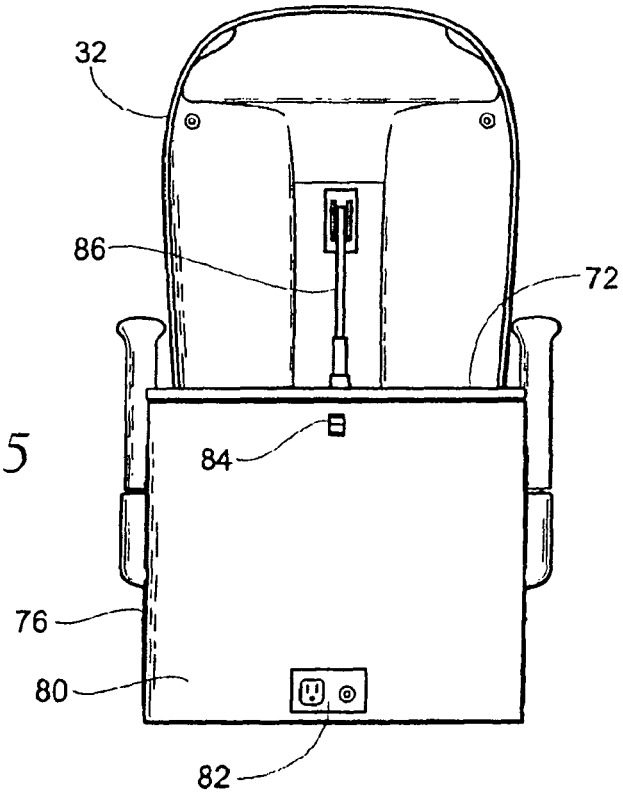
FIG. 5 is a rear elevation view of the medical examination table of FIG. 1.

To facilitate movement of the seat back 26 relative to the seat bottom 28 a tilt mechanism is provided. Referring to FIG. 5, the tilt mechanism is shown as a strut 86 that is centrally located relative to the seat back 26. The strut 86 includes a first end 83 pivotally coupled relative to the seat bottom 28 and a second end 85 pivotally coupled to one of the second base 34 and the seat bottom 28. The strut 86 is operably coupled to an activation device (shown as an actuator 20 in FIG. 19) which provides controlled movement for the seat back 26. The strut 86 acts as a gas spring or shock absorber for the seat back 26, thereby allowing relatively smooth movement of the seat back 26 between various positions. The actual structure of the strut 86 depends on whether the table 10 is configured for manual or powered controls and may include any electrical, mechanical or other device that assists in movement of the seat back 26.

According to various alternative embodiments, any of a number of known or otherwise suitable mechanisms, either manual, powered or a combination thereof can be used to facilitate the movement of the seat back 26 relative to the seat bottom 28. For example, the tilt mechanism may be any of a variety of air, gas, liquid, elastomer, spring, or hydraulic devices, shocks, or shock absorber, dashpot mechanisms, air spring, cylinders, actuators that can selectively move the seat back 26.

Referring back to FIGS. 1 through 3, the patient support 30 further includes the second base 34. The second base 34 supports the patient support structure 32, and more specifically, supports the seat bottom 28. The second base 34 moves with the seat bottom 28 as the patient support 30 is moved between the lowered position and the raised position. According to an exemplary embodiment, the second base 34 provides one or more storage areas suitable for supporting a variety of articles, and may further be configured to support one or more auxiliary components of the table 10. For example, as detailed below, the second base may be configured to support a variety of auxiliary components such as a work surface 64, or one or more support arms, shown as a pair of grab bars 38, that further act as arm rests for a person sitting on the patient support structure 32.

According to an exemplary embodiment, the second base 34 is shown as a box-like structure disposed under the seat bottom 28. The size of the second base 34 is maximized and extends substantially to the periphery of the seat bottom 28 (e.g., laterally side-side and in a longitudinally front-to-back, etc.). Increasing the size of the second base 34 increases the available storage therein. However, limiting the size of the second base 34 to the boundaries of the seat bottom 28 may be both aesthetically pleasing (since the second base 34 is substantially concealed when looking down from the seat bottom 28) and functional (e.g., improves a caregiver's clearance around the table 10, provides for a more compact table, etc.). According to various alternative embodiments, the second base 34 may only take up a portion of the space available under the seat bottom 28 (e.g., in a lateral direction and/or in a longitudinal direction, etc.) and/or may outwardly extend from at least one side of the seat bottom 28.

The height of the second base 34 may vary depending upon a number of factoring including the desired height of the seating surface 29 of the seat bottom 28 in the lowered position. According to an exemplary embodiment, the second base 34 has a height of approximately 10 inches to approximately 18 inches. According to alternative embodiments, the height of the second base 34 may be greater or less than 10 inches or 18 inches.

Figure 4:
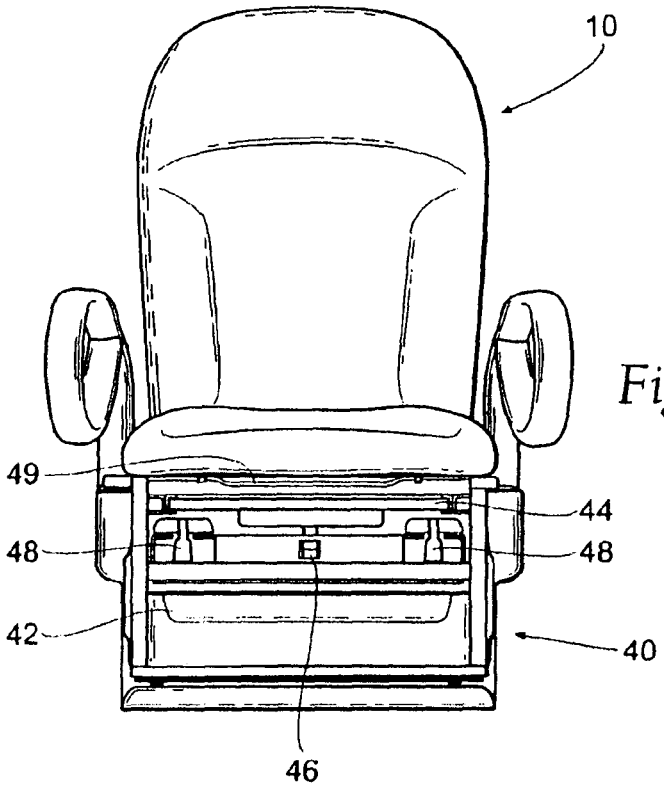
FIG. 4 is a front elevation view of the medical examination table of FIG. 1.

Referring to FIG. 4, the second base 34 provides a storage area, shown as a front storage area 40, that is accessible from a front side of the second base 34. The front storage area 40 comprises a drawer, shown as a removable storage bin 42. The storage bin 42 allows a user to maximize the overall storage area of the table 10, which further enhances the overall utility of the table 10. According to an exemplary embodiment, the storage bin 42 is a relatively large or oversized receptacle extending in a longitudinal direction between a front side of the second base 34 and a rear side of the second base 34 and in a lateral direction between a left side of the second base 34 and a right side of the second base 34. Providing a storage receptacle of such size may advantageously allow the receptacle to be used to store any of a number of items. The storage bin 42 is also easily removed when necessary for cleaning and the like, and may include a stop mechanism (not shown) to reduce the likelihood that the storage bin 42 may be inadvertently removed from the front storage area 40.

Figure 10:
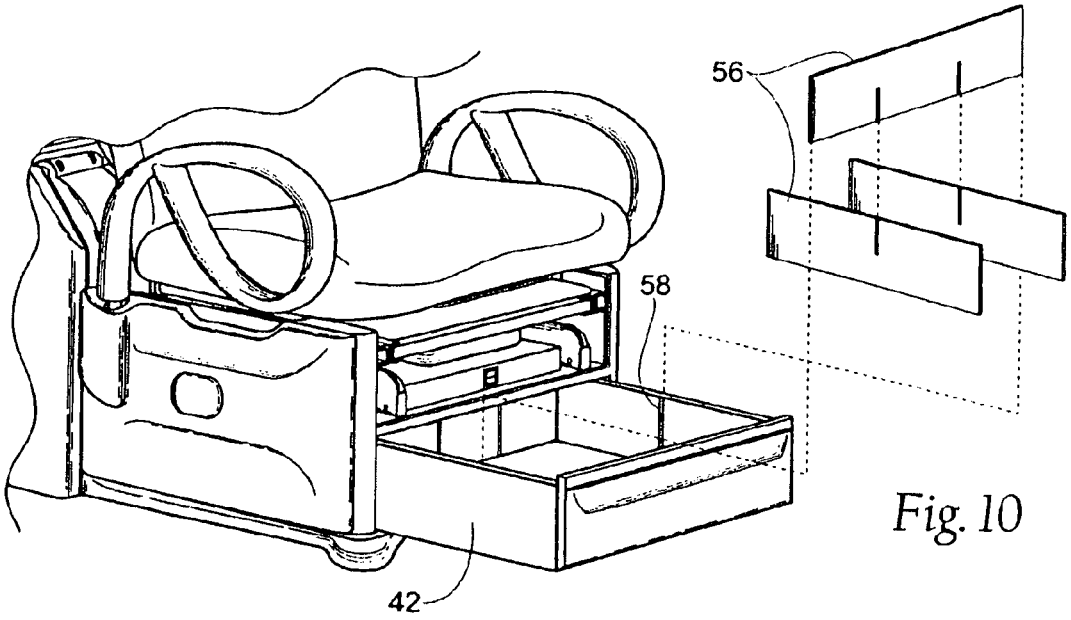
FIG. 10 is a partially exploded perspective view of a seat area and a storage area of the medical examination table of FIG. 1.

Referring to FIG. 10, the storage bin 10 may be divided or partitioned into compartmentalized storage areas to provide for improved organization or for the efficient use of the storage space. To facilitate the division or partition of the storage bin 42 into compartmentalized storage areas, one or more dividers are provided. According to the embodiment illustrated, the storage bin 42 is configured to receive a plurality of multi-configurable partitions or dividers 56 that are secured within slots 58 located on the sidewalls of the storage bin 42 and can be added or removed relatively easily and quickly. The dividers 56 may be arranged to divide and compartmentalize the storage bin 42 according to an individual's needs or preferences. By allowing a more efficient and easier manner of organizing materials, the table 10 provides a useful storage space.

Figure 11:
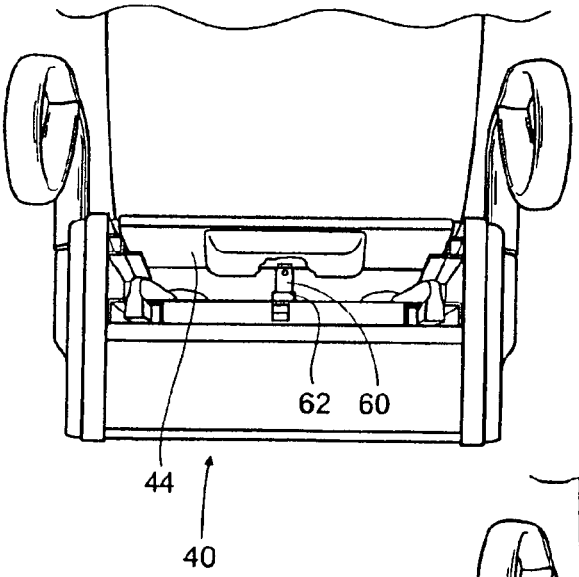
FIGS. 11 and 12 are both perspective views of the seat area and the storage area of the medical examination table of FIG. 1.
Figure 12:
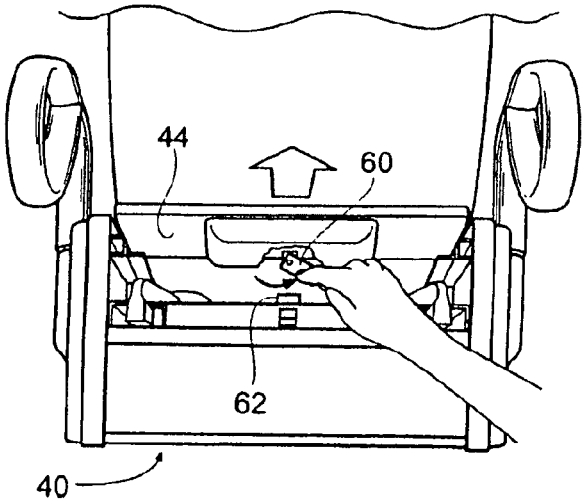

The front storage area 40 also comprises additional space that can accommodate a device, pan, and/or a tray 44. Referring to FIG. 11, the tray 44 is shown having a downward hanging arm 60 that comes in contact with a stop 62. The tray 44 should be considered broadly to include a wide range of devices and designs, such as, but not limited to, padded surfaces, urology pans, storage devices, or other related containers. The hanging arm 60 and the stop 62 prevent the tray 44 from being inadvertently removed when the tray 44 is pulled out to be accessed. However, if the tray 44 needs to be removed, possibly for cleaning or being replaced with a different device or component, FIG. 12 shows how this is accomplished. The hanging arm 60 is pivotally attached to the tray 44. When removal is necessary, the arm 60 is moved to either the left or right and can be moved past the stop 62 and removed. A heating module (not shown) may be installed on the second base 34 to warm the tray 44. Stirrups 48 are also located in the front storage area 40 without impeding movement of the storage bin 42 and the device 44, while still being able to be stored away when not in use.

Figure 26:
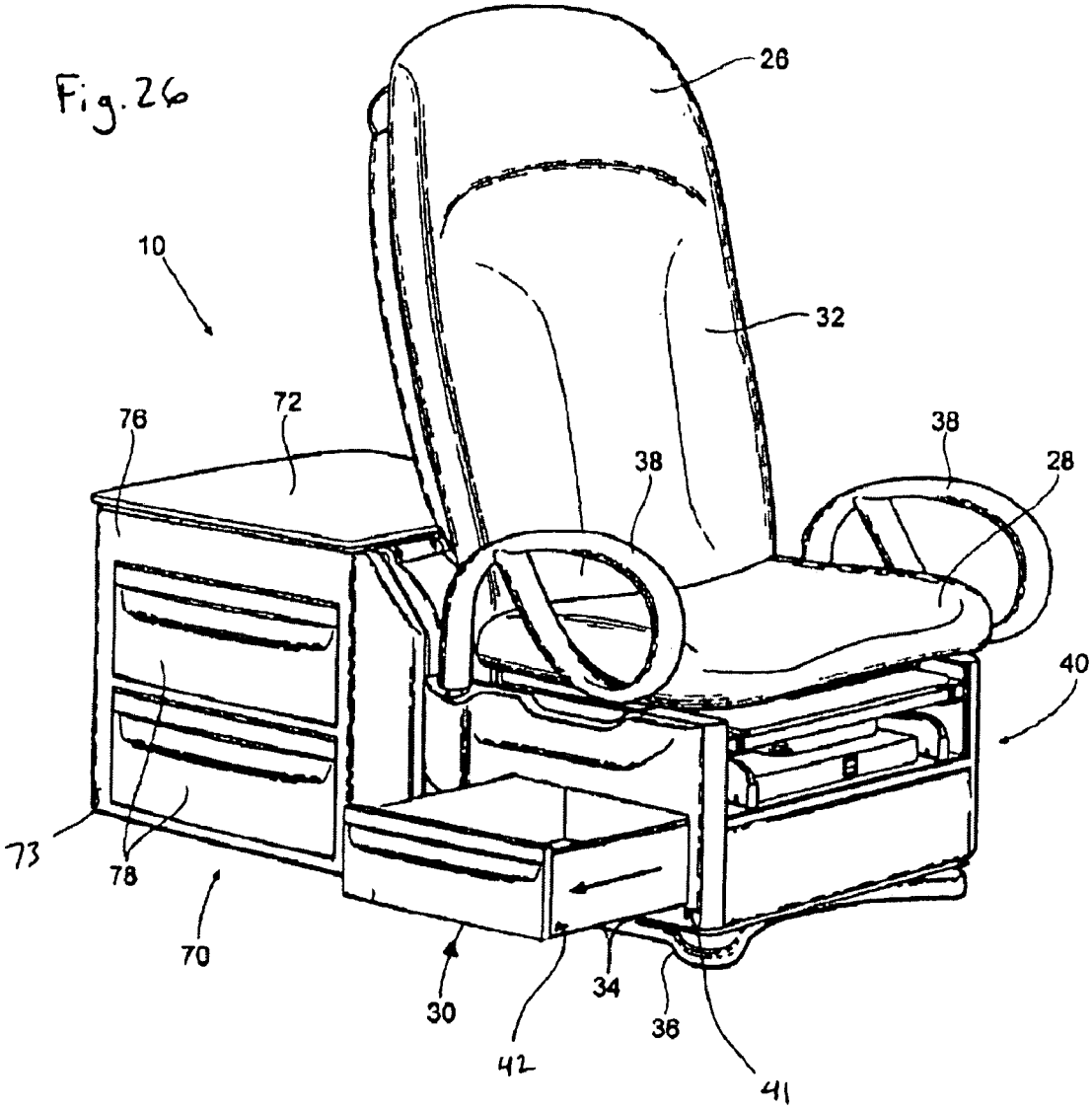
FIG. 26 is a perspective view of a medical examination table according to another exemplary embodiment showing a side drawer under a seat bottom.

FIG. 26 shows the second base 34 according to another exemplary embodiment. In such an embodiment, the second base 34 includes a storage area accessible from at least one of the lateral sides of the second base 34. Such a storage area is shown as a side storage area 41. Similar to the front storage area 40, the side storage area 41 is shown as receiving a drawer, shown as the removable storage bin 42. For such an embodiment, the storage bin 42 may be configured as drawer as described above or as a pass-through drawer that is detailed below that would be accessible from both lateral sides of the second base 34.

It should be noted that the front storage area 40 and the side storage area 41 may have storage configurations other than those suitable for receiving a drawer. For example, either one of the front storage area 40 and the side storage area 41 may include one or more shelves, cabinets doors, storage racks, or any other suitable storage configuration.

Figure 13:
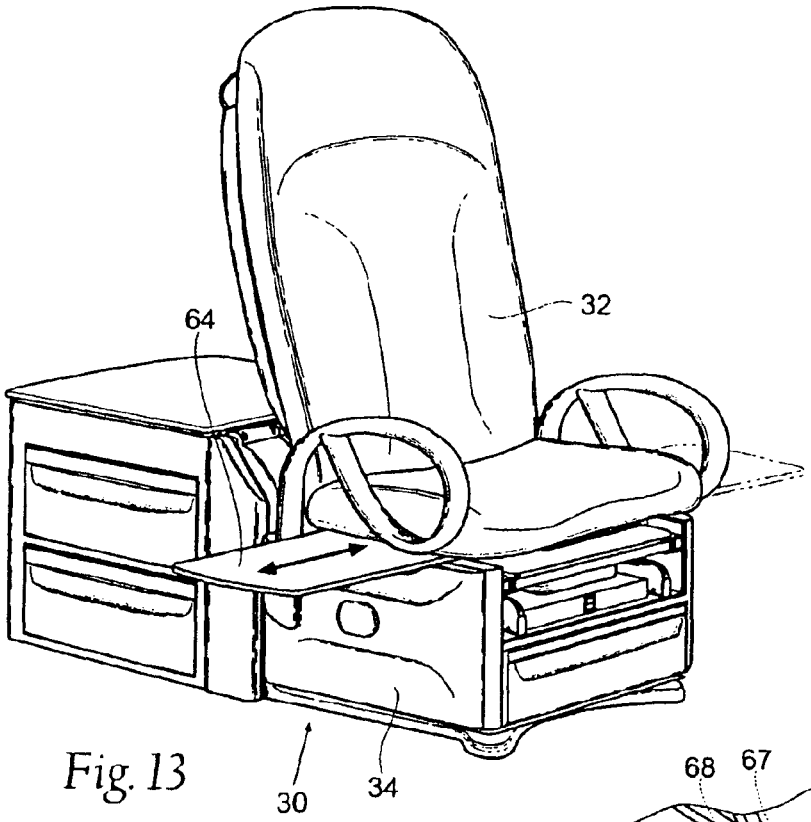
FIGS. 13 and 14 are both perspective views of the medical examination table of FIG. 1 showing a worksurface according to an exemplary embodiment.
Figure 14:
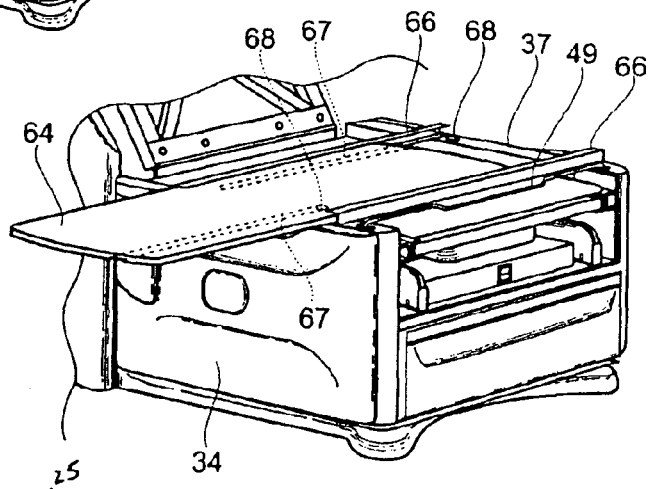
Figure 14A:
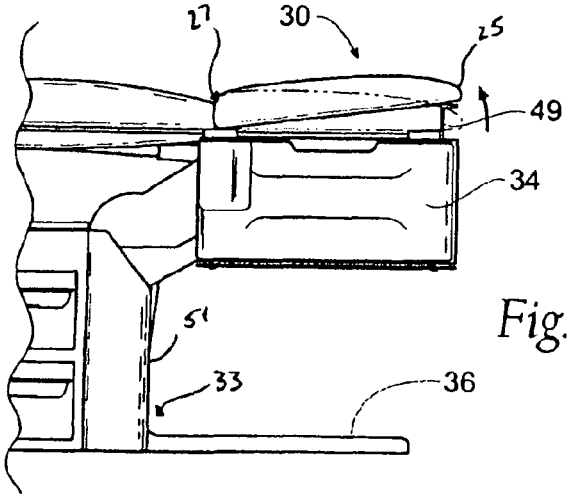
FIG. 14A is a partial side elevation view of the medical examination table of FIG. 1 showing the seat area in a tilted position.
Figure 15:
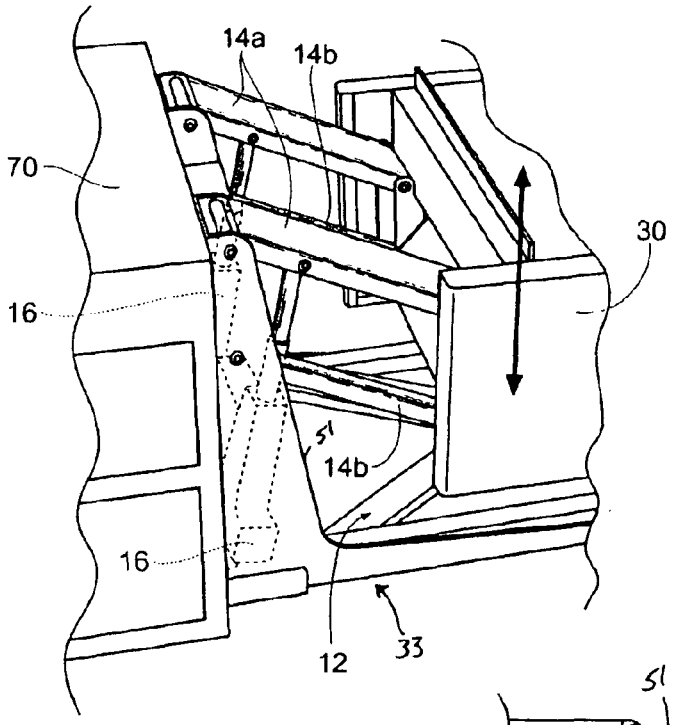
FIG. 15 is a perspective view of a drive and linkage assembly according to an exemplary embodiment.
Figure 16:
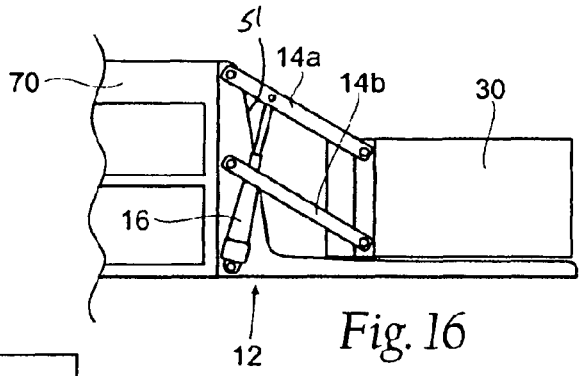
FIGS. 16 through 18 are side elevation views showing the drive and linkage assembly supporting the seat area in various positions.
Figure 17:
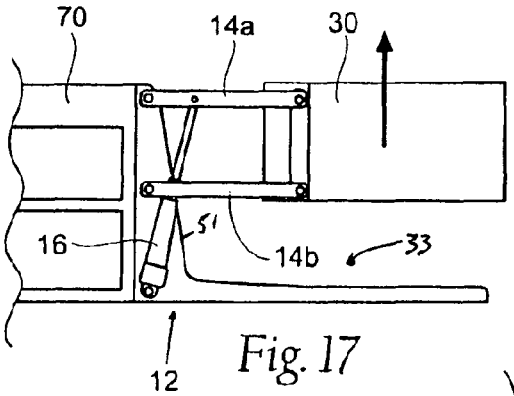

Referring to FIGS. 13 and 14, the second base 34 is further shown as supporting a platform, shown as the work surface 64. The work surface 64 advantageously provides a surface for the medical practitioner that can be useful for writing or for placing instruments upon. The work surface 64 is coupled relative to the seat bottom 28 and may be supported at a variety of positions relative to the seat bottom 28. For example, the work surface 64 may be supported relative to a front end of the seat bottom 28, a right side 21 of the seat bottom 28, a left side 23 of the seat bottom 28, and/or combinations thereof. According to an exemplary embodiment, the work surface is coupled to at least one of the seat bottom 28 and the second base 34, but in alternative embodiments may be coupled to another structure and supported adjacent to the seat bottom 28.

According to an exemplary embodiment, the work surface 64 is configured to be selectively moved between a stowed or retracted position and a use position. In the use position, the work surface 64 is generally supported closely adjacent to the seat bottom 28 and may be provided at a height that is similar to the height of the seating surface 29. According to an exemplary embodiment, the work surface 64 is stowed under the patient support surface 32 and is moved to the use position when desired. According to various alternative embodiments, the work surface 64 may collapsible and/or pivotally coupled relative to the seat bottom 28 such that it is stowed without being stowed under the seat bottom 28. For example, the work surface 64 could be folded away, such as along the side or back of the second base 34.

According to the embodiment illustrated, the work surface 64 is slidably coupled to the second base 34 and located below the seat bottom 28. The work surface 64 may be configured to slide out relative to one or more of the lateral sides of the seat bottom 28. As shown by the arrows, the work surface 64 in the embodiment illustrated can be pulled out from either direction, thereby accommodating right- and left-handed persons and accommodate the examiner on either side of the table 10. Having the work surface 64 stored on the table 10 and accessible from either side of the seat bottom 28 advantageously improves the effectiveness and/or usefulness of the table 10 within the examination room.

According to an exemplary embodiment, the work surface 64 is designed so that it will not be inadvertently removed from the table 10. As shown in FIG. 14, the outside edges of the work surface 64 rest within channels 66 that allow the work surface 64 to slide back and forth. Grooves 67 are located on the underside of the work surface 64, which allow the board 64 to slide over a pair of bumpers 68, located on oppositely disposed corners of the upper surface 37 of the second base 34. Thus, the work surface 64 will only be pulled out until the end of one the grooves 67 comes in contact with a corresponding bumper 68. The bumpers 68 or other similar devices may be removed when necessary, to accommodate cleaning of the work surface 64. For example, the bumpers 68 could be threadably engageable with the upper surface 37 and unthreaded when cleaning is necessary, or possibly the bumpers 68 could be depressable to allow the work surface 64 to slide over the bumpers 68.

Referring to FIGS. 1 and 2, the second base 34 is further configured to support the grab bars 38. The grab bars 38 may be used by patients for support when on the patient support structure 32, for assistance onto and off of the patient support structure 32, and/or for assistance when repositioning themselves on the patient support structure 32. The grab bars 38 further act as bed rails to help prevent a person from rolling off of the patient support structure 32 when the patient support structure 32 is fully reclined to form a bed. The grab bars 38 are designed to provide multiple grab points for a patient, thereby accommodating a wide range of patients. The grab bars 38 extend outwardly to the front of the seat bottom 28, which aids patients in properly positioning and orientating themselves on the patient support structure 32.

The grab bars 38 are designed in a manner so that clearance is provided for the work surface 64 (if provided) when the work surface 64 is in a use or extended position. More specifically, the grab bars 38 are designed such that the medical practitioner may be utilizing the benefits of the work surface 64, while a patient supported on the patient support structure 32 is simultaneously utilizing the benefits of the grab bars 38. Referring back to FIG. 13, the work surface 64 is designed to slide under the grab bar 38 when moved between a stowed and use position.

Referring further to FIGS. 1 and 2, the grab bars 38 act as arm rests and/or bed rails for the patient support structure 32 depending on the position of the patient support 30. The grab bars 38 are configured to be selectively moved between a first position (e.g., an arm rest position, chair position, etc.) and a second position (e.g., a bed rail position, bed position, etc.). The first position is shown as being substantially 180 degrees offset from the second position. According to an exemplary embodiment, the grab bars 38 are configured to be rotated between the first position and the second position while remaining coupled to the second base 34.

As detailed below, the grab bars 38 are also configured to be selectively moved to a third position (e.g., release position, removal position, etc.), the third position being located somewhere between the first position and the second position. The grab bars 38 can also be moved to any of a number of intermediate positions between the first position and the second position to accommodate the needs of the patient and/or the medical practitioner conducting the examination. For example, the grab bars 38 may be moved to a position that allows a patient to enter or exit the patient support 30 from the side. This may be useful when transferring a wheelchair patient to or from the patient support 30.

Figure 6:
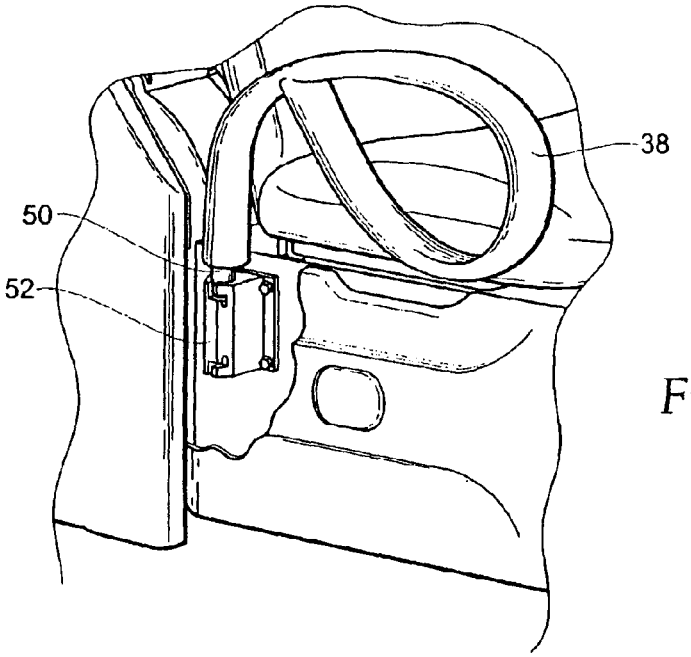
FIG. 6 is a detailed perspective view of a grab bar assembly according to an exemplary embodiment and shown in a first position.
Figure 7A:
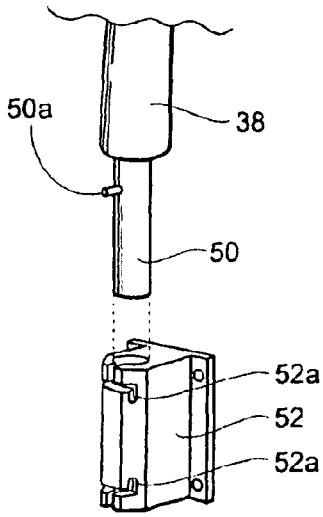
FIG. 7A is an exploded view of the grab bar assembly of FIG. 6.
Figure 7:
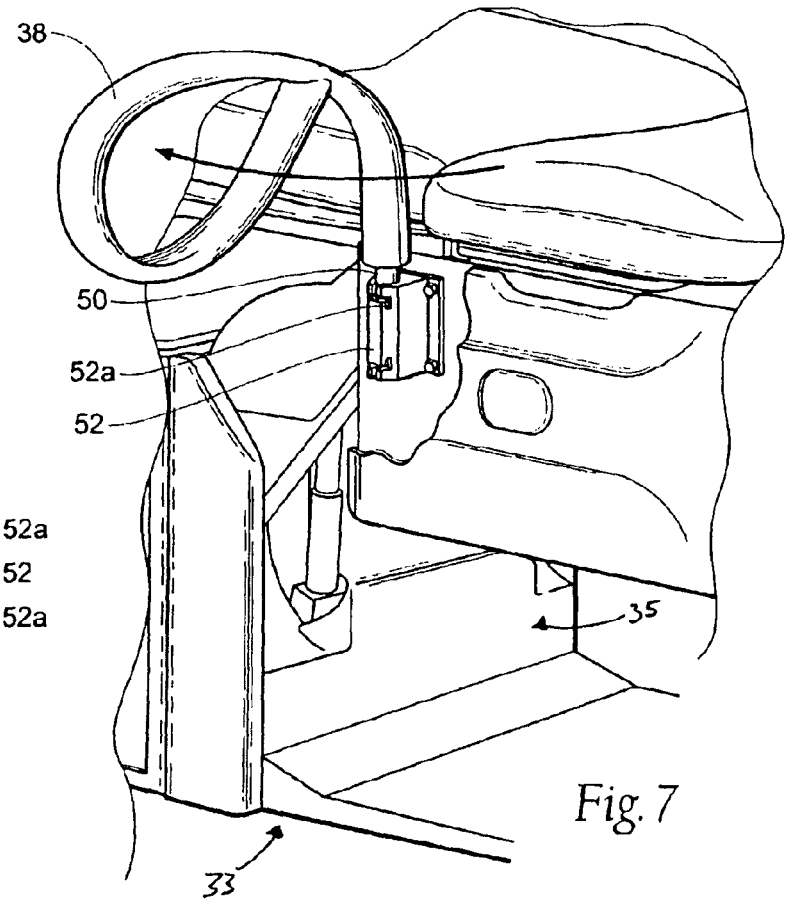
FIG. 7 shows a grab bar of the grab bar assembly of FIG. 6 in a second position.

FIGS. 6 through 7A show the grab bars 38 according to an exemplary embodiment. FIG. 6 depicts the grab bar 38 as associated with FIG. 1 and FIG. 7 depicts the grab bar 38 as associated with FIG. 3. It should be noted that movement (e.g., rotation, etc.) of the grab bar 38 is independent of the movement of the patient support 30. According to various alternative embodiments, the movement of the grab bars 38 may be coupled to the movement of the patient support 30. For example, the grab bars 38 may be configured to move towards the first position when patient support 30 is moved to the substantially upright position.

According to the embodiment illustrated, each grab bar 38 has a shaft 50 that is pivotally inserted into a mount 52. The shaft 50 and the mount 52 are designed to prevent inadvertent removal of the grab bars 38. A protrusion 50*a* located on the shaft interacts with a slot 52*a* on the mount. This allows only selective removal of the shaft 50 from the mount 52.

When the grab bar 38 is in a support position (as shown in FIG. 6), the shaft 50 is locked within the mount 52 and may not be removed. Not only does this prevent the grab bar 38 from being improperly removed from the table 10, it also insures that the grab bar 38 will not move unnecessarily when a person needs extra support getting onto and off of the table 10. The grab bar 38 may only be removed when it has been moved from a support position (i.e., any position between the first position and the second position) to the third or removal position. According to an exemplary embodiment, the removal position is angularly offset approximately 90 degrees from the first position and/or the second position. According to various alternative embodiments, the removal position may be at an angle other than 90 degrees and may be at an angle outside of the first position and/or the second position.

As shown in the drawings, and particularly in FIG. 7A, the mount 52 is shown having two slots 52*a*. As shown, the protrusion 50*a* will only interact with the upper slot. The mount 52 is designed with two slots 52*a* so that the same mount 52 can be used for both the left and the right side of the table, thereby simplifying the assembly and manufacture of the table. The slot 52*a* in FIG. 7A is shown to extend through and across the mount 52. This arrangement would be suited for when the grab bars 38 would also be rotated 180 degrees for use as guard rails when the patient support 32 is in a bed-like position. According to another embodiment, the female/male arrangement of the shaft 50 and the mount 52 could be reversed.

According to another exemplary embodiment, the grab bars 38 can be designed and arranged so that they will be prevented from rotating completely 180 degrees between the first position and the second position. This may prevent the grab bars 38 from interfering with the movement various rear storage compartments when the table 10 is in a position as shown in FIG. 1. However, such an arrangement will still allow easy access for a patient and the grab bars 38 will still assist a person in getting on and off of the table 10.

The second base 34 may also support a device for adjusting the tilt of the seat bottom 28. Referring to FIGS. 4, 14, and 4A, a pelvic tilt device 49 is shown according to an exemplary embodiment. The pelvic tilt device 49 further allows the table 10 and the patient support structure 32 to be repositioned as necessary. The tilt device 49 is shown as comprising an adjustable bar that can be locked thereby placing the seat bottom 28 in a tilted position and be released when the tilt position is not needed. According to various alternative embodiments, any of a number of suitable tilt mechanisms may be used to tilt the positioning the seat bottom 28 relative to the second base 34. It should be noted that even with the seat bottom 28 tilted by the tilt device 49, the seat back 26 is still considered to be substantially horizontal with the seat bottom 28 when moved to the bed-like position.

To support the patient support 30 and the various components thereof, the first base 33 is provided. Referring to FIGS. 2 and 15 through 18, the first base 33 is shown as comprising a first structure (e.g., horizontal support, footprint, etc.), shown as a support extension 36, and a second structure (e.g., vertical support, etc.), shown as a wall 35. The support extension 36 outwardly extends from the wall 35 in a direction that is substantially perpendicular to the wall 35 and in such a direction that the support extension 36 is provided under the seat bottom 28 and second base 34 of the patient support 30. The support extension 36 is shown as a substantially continuous member, but alternatively may be provided as discontinuous structure (e.g., a pair or prongs or forks outwardly extending from a bottom edge of the wall 35.

The wall 35 upwardly extends relative to the support extension 36 and is defined at least in part by a front surface 51. The front surface 51 may be a substantially linear surface, a curvilinear surface, or include both linear and curvilinear portions. According to the embodiment illustrated, the front surface 51 is a substantially vertical surface. Configuring the front surface 51 in this manner may provide clearance for the movement of the seat bottom 28 and the second base 34.

The first base 33 may be suitable for supporting the patient support 30 without requiring the assistance of any other structure (e.g., rear storage section 70). According to an another embodiment, the first base 33 may not include the support extension 36 or an equivalent thereof. Rather the rear storage section 70 (detailed below) or the wall 35 may be adequately weighted and configured to support the patient support 30.

To facilitate the movement of the patient support 30 between the lowered position and the raised position, the lift mechanism is provided. The lift mechanism is coupled between the first base 33 and the patient support 30 and is configured to move the patient support 30 without moving the first base 33. According to an exemplary embodiment, the lift mechanism comprises a linkage system 12 for moving the patient support 30. The linkage system 12 allows the patient support 30 to be easily moved between a wide range of heights, and allows the patient support 30 to move separately and independently from the storage section 70.

Referring to FIGS. 15 through 18, the linkage system 12 comprises one or more links or bars, referred to collectively with the reference numeral 14, and one or more actuators, referred to collectively with reference numeral 16. According to an exemplary embodiment, the linkage system 12 comprises four bars, two parallel upper bars 14*a* and two parallel lower bars 14*b*, which provide stability for the table 10 over a wide range of weights. The upper bars 14*a* and the lower bars 14*b* each include a first end pivotally coupled to the first base 33 and a second end pivotally coupled to the second base. The upper bars 14*a* are each coupled to a respective actuator 16. The actuator 16 extends through or from a plane of the front surface 51 of the first base 33 with a first end pivotally coupled to the first base 33 and a second end pivotally coupled to the patient support 30, and more specifically, to the upper bar 14*a*.

Figure 18:
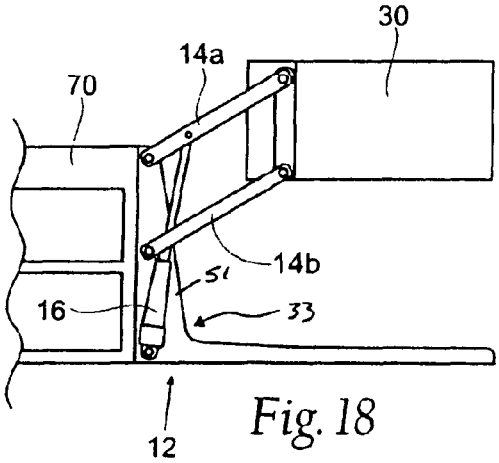

The actuator 16 is configured to move between a retracted position (shown in FIG. 16) and an extended position (shown in FIG. 18). When the actuator 16 is in the extended position, the patient support 30 is in the raised position. When the actuator 16 is in the retracted position, the patient support 30 is in the lowered position. In both the lowered position and the raised position, the seat bottom 28 of patient support 30 is supported so that the seating surface 29 defines a substantially horizontal plane. The arrangement of the link bars 14*a*, 14*b* and the actuator 16 allow the seat bottom 28 to be lifted between the lowered position and the raised position while keeping the plane defined by the seating surface substantially fixed through at least a portion of the range of movement of the seat bottom 28. According to the embodiment illustrated, the linkage system 12 lifts the seat bottom 28 while keeping the plane of the seat surface 29 fixed in a substantially horizontal plane during the entire range of movement.

According to an exemplary embodiment, the actuator 16 is a push-only actuator designed to lift the patient support 30 when moved to an extended position. As a push-only actuator, the actuator 16 relies on gravity alone to move or return the actuator 16 to a retract position. The other actuators 16 used throughout the table 10 may also be push-only actuators. Using push-only actuators may reduce the likelihood that the table 10 will be damaged from being driven down on an object (e.g., a stool 8, etc.).

According to various alternative embodiments, the lift mechanism may any of a variety of known or otherwise suitable devices including, but not limited to, a scissor-lift, a chain drive, a rack and pinion, hydraulic cylinders, castings, or other devices. According to a further alternative embodiment, a second lift system may be provided so that the rear storage section 70 (detailed below) is also movable, which may enhance the usefulness of the table.

Figure 22:
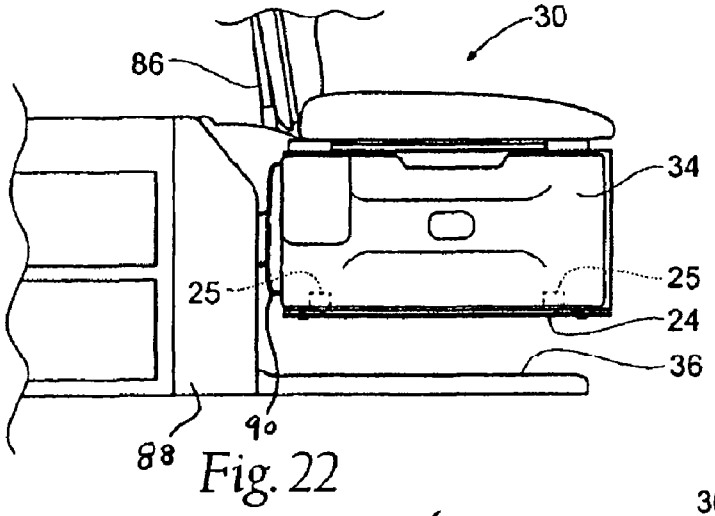
FIG. 22 is a partial right side elevation view of the medical examination table of FIG. 1 showing the seat area.
Figure 23:
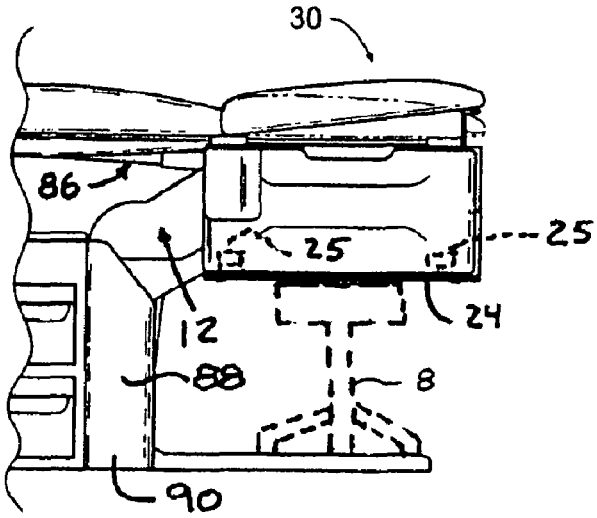
FIG. 23 is a partial right side elevation view of the medical examination table of FIG. 1 showing the seat area with another object detection system of the medical examination table engaged.

FIGS. 22 and 23 show a shroud 88 (e.g., cover, shield, close-out device, etc.) that generally covers the linkage system 12 to shield or otherwise conceal the linkage system 12. The shroud 88 may extend over a top portion of the linkage system 12 and/or over a side portion of the linkage system 12. The shroud 88 may also conceal or interact with a pair of switches or blades 90 (one on each side of the second base 34) having sensors coupled thereto as part of the object detection system. Such sensors, when activated, may restrict the movement of the patient support 30. For example, a slight gap is located between the second base 34 and the first base 33 near the shroud 88. If this gap is reduced, such as by coming into contact with an object, sensors or switches coupled to the blades 90 will restrict further movement of the patient support 30.

Figure 8:
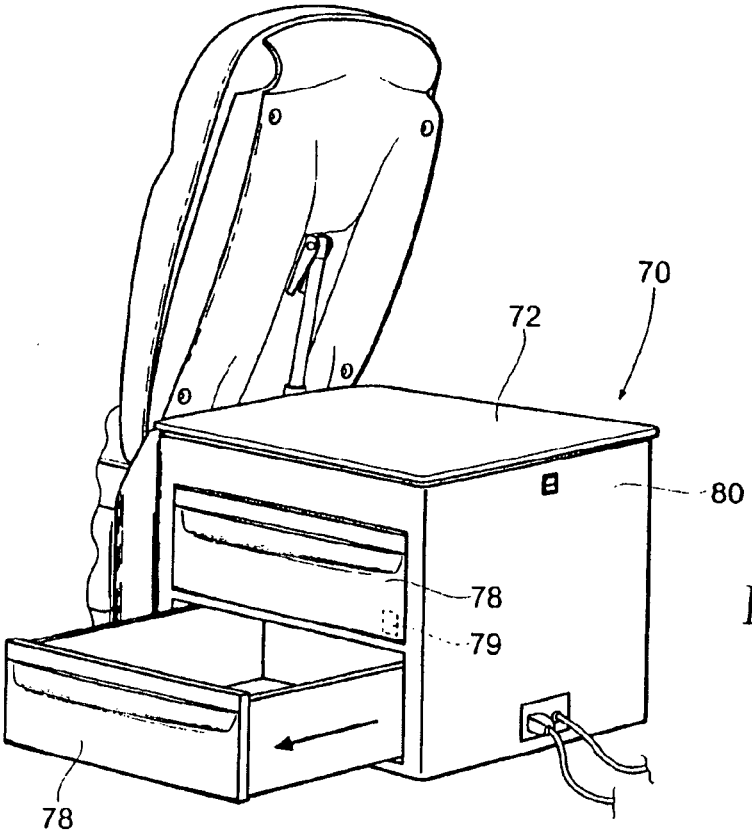
FIG. 8 is a rear perspective partial view of the medical examination table of FIG. 1.
Figure 9:
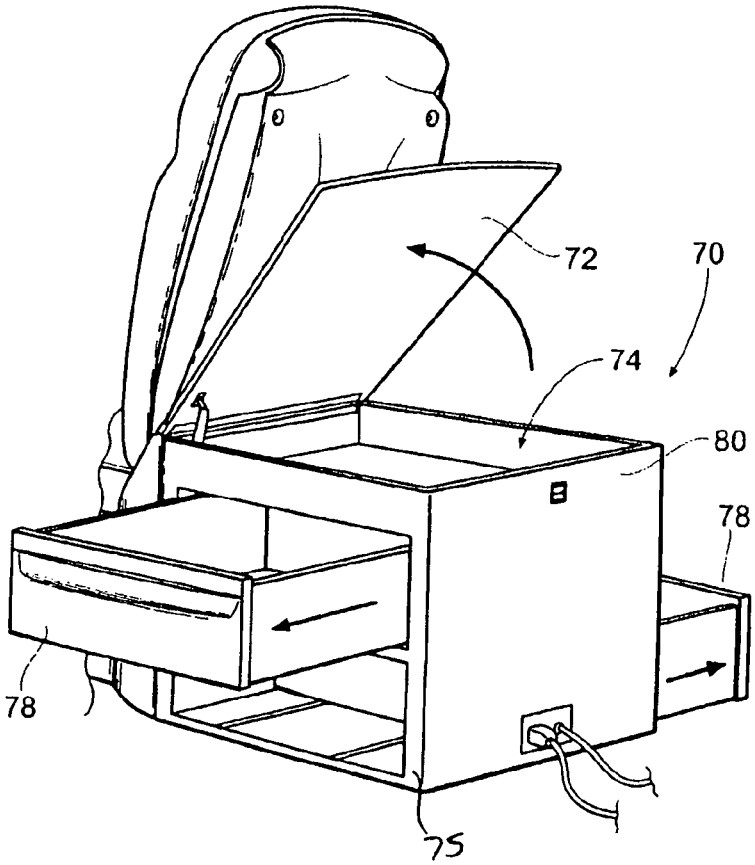
FIG. 9 is another rear perspective partial view of the medical examination table of FIG. 1.

Provided rearward of the first base is the rear storage section 70 providing a rear storage area. As noted above, the rear storage section 70 is suitable for supporting one or more articles related to the medical procedure (e.g., supplies, equipment, instrumentation, etc.). Referring to FIGS. 8 and 9, the rear storage section 70 is shown as a box-like body or cabinet 76. Similar to the first base 33, the movement of the patient support 30 is independent or separate of the cabinet 76. In other words, the linkage system 12 can move the patient support 30 between the lowered position and the raised position without lifting the cabinet 76. Such a configuration may advantageously allow storage areas of the table 10 to remain accessible to a medical examiner or caregiver regardless of the position of the patient support 30.

The cabinet 76 is at least partially defined by a top surface 72, a back surface 80, a first lateral side surface, shown in FIG. 1 as a right side surface 73, and a second lateral side surface, shown as a left side surface 75. The top surface 72 is a substantially flat surface that can be used for supporting objects upon when the patient support structure 32 is in the substantially upright position (i.e., a chair position). As detailed below, the table 10 may include a system designed to reduce the likelihood that objects placed upon the top surface 72 will be damaged or crushed in the event that the patient support structure 32 is moved into another position.

According to an exemplary embodiment, the top surface 72 also functions as a lid or cover for a storage area 74 (see FIG. 9), which can be used for storage of items, such as paper rolls that cover the patient support structure 32. According to various alternative embodiments, the top surface 72 may be eliminated and the storage area may be exposed to the ambient environment. However, providing the top surface 72 over the storage area 74 conceals the storage area 74 and protects the storage area 74 against the introduction of contaminants (e.g., dust particles, spilled fluids, etc.). Use of the top surface 72 as a lid allows the storage area 74 to remain concealed throughout the various movements of the patient support structure 32. The storage area 74 will be exposed or be accessible only when the medical examiner or caregiver selectively opens the lid.

According to the embodiment illustrated, the top surface 72 is pivotally coupled at a front edge of the cabinet 76. Coupling the top surface 72 in this manner may allow the top surface to be at least partially opened even when the seat back 26 is partially reclined. A latch device 77 may be provided to support the top surface 72 in an open position. According to various exemplary embodiments, the top surface 72 may take on any of a number of forms for providing a lid. For example, the top surface 72 may be divided or segmented, with only a portion of the top surface 72 functioning as a lid. Further, the top surface 72 may be hinged to any edge or portion of the cabinet 76. Further still, the top surface 72 may be configured to open in ways other than pivotal movement (e.g., by sliding or retracting into a portion of the cabinet 76, etc.).

Referring further to FIGS. 8 and 9, the cabinet 76 is also configured to house or support one or more drawers that may be accessible from the right side 73 and/or the left side 75. According to the embodiment illustrated, a pair of pass-through drawers 78 are received by the cabinet 76. The drawers 78 are slidable through the cabinet 74 (between the right side 73 and the left side 75) and are easily accessible on either side of the table 10. The drawers 78 are substantially similar to the drawers discussed in U.S. Pat. No. 6,568,008, owned by the same assignee and incorporated by reference.

Movement of the drawers 78 does not interfere with the opening and closing of the storage area 74. Further, as shown in FIG. 9, the drawers 78 may be opened or closed from either side of the table 10, and may also be opened or closed concurrently. The drawers 78 may also be opened or closed when the table 10 is any position. Thus, the table 10 provides accessibility to the storage area 70 during any of several examination procedures, which reduces the need for other storage areas in the room that contains the table 10. Likewise, because the drawers 78 may be opened from either side, the table 10 equally suits left- or right-handed practitioners and provides more options of arranging the table 10 within a small examination room. As shown in phantom in FIG. 8, a lock or other device 79 can be used to prevent the drawers 78 from going completely through, which is preferable if the table 10 is situated where access from only one side of the table is warranted or desired.

Providing a storage area accessible to a medical practitioner along a lateral side of the table 10 may optimize the location of an item for use during the examination or procedure. The type of storage provided along the lateral sides of the table 10 is not limited to the use of drawers 78. For example, the cabinet 76 may include one or more shelves, racks, cabinet doors concealing a storage compartment, or any other suitable form of storage.

FIG. 5 shows a rear elevation view of the table 10 and the cabinet 76. According to the embodiment illustrated, the back surface 80 of the cabinet 76 is configured to support the necessary electrical connections 82 to provide power for the table 10. Also located on the back surface 80 is an on/off switch 84 that allows a practitioner to turn off power for movement of the table 10 when the practitioner leaves the room. The placement of the switch 84 on the back surface 80 of the cabinet 76 is also advantageous in that it can be activated or deactivated discretely without alerting others in the room to the location of the switch 84. The top surface 72 is also preferably designed to extend outward over switch 84, thereby further concealing the switch 84.

Figure 25:
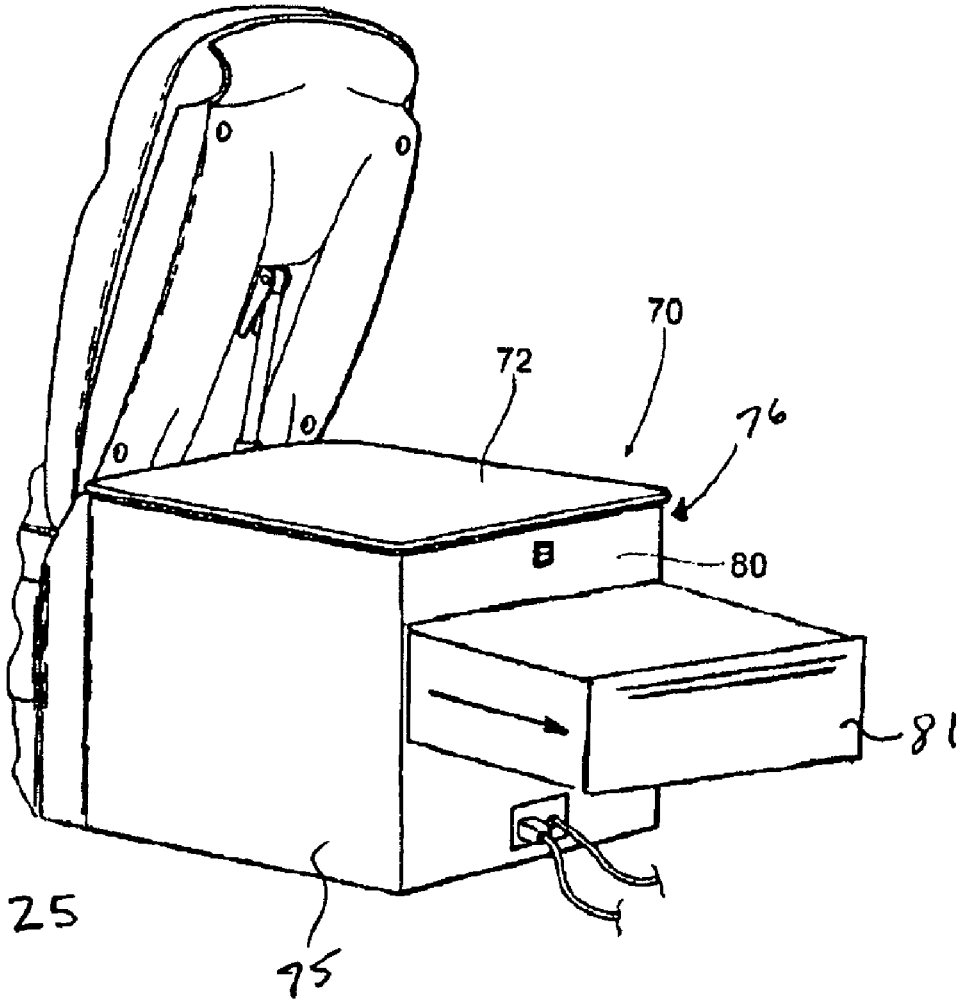
FIG. 25 is a rear perspective partial view of a medical examination table according to another exemplary embodiment showing a rear drawer.

Referring to FIG. 25, the rear storage section 70 may alternatively be provided with a storage area accessible from the rear surface 80. Providing a storage area accessible to a medical practitioner at the rear surface 80 may also optimize the location of an item for use during the examination or procedure. The type of storage provided along the rear surface 80 may be any of a variety of suitable storage arrangements. For example, the cabinet 76 may include one or more shelves, racks, cabinet doors concealing a storage compartment, or any other suitable form of a storage arrangement. According to the embodiment illustrated, the storage area is configured to receive a drawer 81 that can be opened or closed when the patient support 30 is any position.

According to an exemplary embodiment, the rear storage section 70 is coupled to the rear side of the first base 33. The rear storage section 70 may be fixedly coupled to the first base 33, or alternatively, may be movably and/or detachably coupled to the first base 33. The rear storage section 70 may be integrally formed with the first base 33 to provide a single unitary base or may be separate component that is selectively added to the table 10. To facilitate the coupling of the rear storage section 70 to the first base, any of a number of suitable techniques may be used including, but not limited to, mechanical fasteners (e.g., bolts, rivets, clips, brackets, clamps, etc.), a suitable welding process, an adhesive, etc.

According to another exemplary embodiment, the rear storage section 70 may be configured as a storage module or pod that is selectively added to the first base 33. These storage modules or pods may having varying storage configurations and/or sizes, each be interchangeable with the first base 33. Such an embodiment may allow examination tables to be supplied the same first base 33 and patient support 30, but with varying rear storage configurations.

According to another exemplary embodiment, the rear storage section 70 may be positioned closely adjacent to the first base 33 without being coupled to the first base 33. For such an embodiment, the first base 33 is configured to support or otherwise stabilize the patient support 30 as it moves between the various positions without the assistance of the rear storage section 70.

Figure 19:
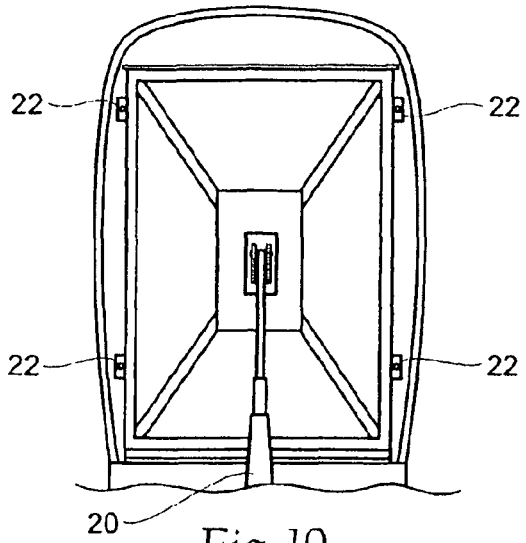
FIG. 19 is a partial rear elevation view of a seat back.
Figure 20:
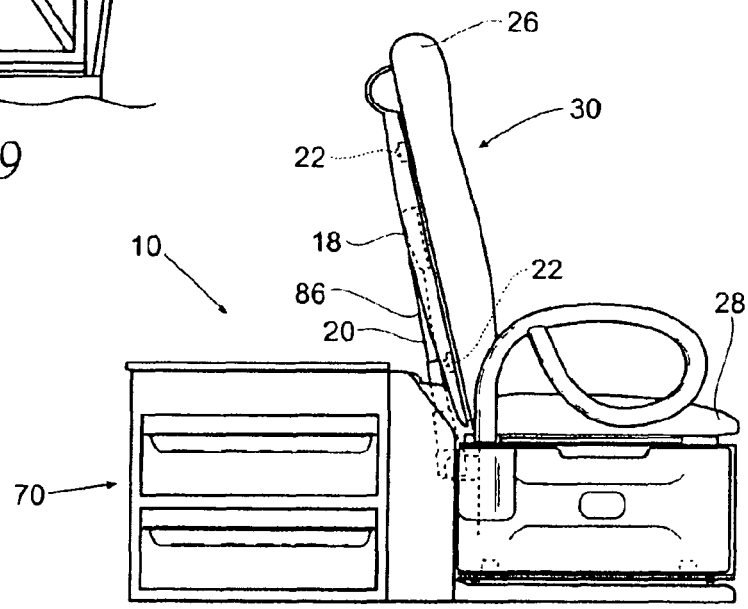
FIG. 20 is a right side elevation view of the medical examination table of FIG. 1 in a lowered and upright position.
Figure 21:
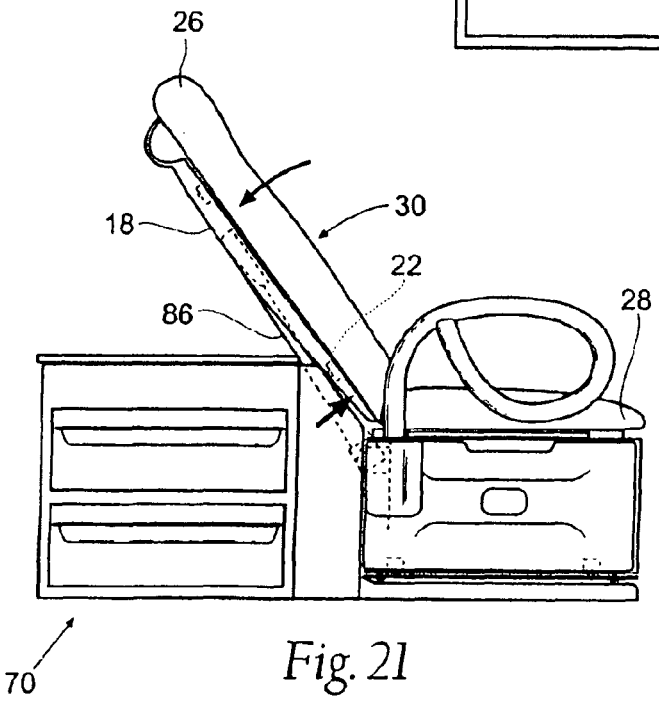
FIG. 21 is a right side elevation view of the medical examination table of FIG. 1 in a lowered and at least partially reclined position with an object detection system of the medical examination table engaged.

As noted above, the table 10 may include one or more systems (e.g., an object detection systems, etc.) designed to restrict the movement of the patient support 30 in the event that an object is placed within the path of movement of the patient support 30. Referring to FIGS. 19 through 21, when the table 10 is repositioned between the substantially upright position (i.e., a chair-like position) and the substantially horizontal position (i.e., a bed-like position), there is potential for the patient support 30 to be inadvertently driven into the rear storage section 70 or another object placed upon the top surface 72 of the rear storage section 70.

It should be noted that according to an alternative embodiment, the table 10 may designed so that the patient support 30 can move automatically between the chair-like and bed-like positions without manually needing to navigate the patient support 30 over and around the rear storage section 70, it may also be possible that the separate parts of the patient support 30 move individually. That is, the seat back 26 may move independently from the seat bottom 28 and, also, independently from the overall movement of the patient support 30.

Referring back to FIGS. 19 through 21, the patient support 30 is shown in a chair-like position. If the seat back 26 is reclined independently from the seat bottom 28, the seat back 26 may be driven into the rear storage section 70, which could possibly cause damage to either the rear storage section 70 or the patient support 30. To reduce the likelihood of such damage, an object detention system may be provided.

According to an exemplary embodiment, the table 10 further comprises a cover 18 located on the back of the seat back 26. One or more sensors or switches 22 are operably coupled between the cover 18 and the seat back 26. There is a slight gap between the cover 18 and the seat back 26. When the cover 18 comes into contact with an abutting surface (e.g., a surface of rear storage section 70), the cover will move inward thereby activating at least one of the sensors or switches 22 and causing the movement of the seat back 26 and/or patient support 30 to cease.

FIG. 19 shows the seat back 26 with the cover 18 removed. Located on the seat back 26 are a plurality of sensors or switches 22, that when activated, are designed to restrict the movement of patient support 30. The sensors or switches 22 are electrically coupled to the circuitry and the controls of the table 10. According to the embodiment illustrated, the sensors 22 are located at each of the four corners of the seat back 26 and cover 18. Such positioning is intended to detect unintended contact and stop movement of the patient support 30 over a wide range of angles and positions. The sensors or switches 22 are a push-in style button or device and extend outwardly in a normal position toward the cover 18. According to various alternative embodiments, any type of sensing or detecting device may be used (e.g., motion, optical, proximity, etc.) and any number of suitable sensors or switches may be provided.

The cover 18 may come in contact with the rear storage section 70 or an object over the normal range of movements of the patient support 30. FIG. 21 shows the cover 18 coming into contact with the rear storage section 70, which moves the cover 18 towards the seat back 26. At the lower section of the seat back 26, the gap between the cover 18 and the seat back 26 is eliminated. This forces a lower sensor or switch 22 to be depressed and deactivates the electrical circuit controlling the movement of the patient support 30, which prevents further movement of the seat back 26.

FIGS. 22 and 23 show an additional object detection system. The second base 34 of the patient support 30 is shown elevated over the support extension 36. A plate 24 is suspended below the bottom of the second base 34 and is movably attached to the second base 34 by a plurality of fasteners, with a gap located between the second base 34 and the plate 24. In FIG. 23, the patient support 30 is shown being moved downward. The patient support 30 may come into contact with an object, such as a stool 8 (shown in phantom), that could impede movement of the patient support 30 and damage the table 10. Sensors 25, similar to the sensors 22, are activated to prevent the movement of the patient support 30. In this situation, the plate 24 is pushed upward, closing the gap between the plate 24 and the second base 34. The sensors 25 are thereby depressed, which inhibits any further movement of the patient support 30 until the object is removed. If continuous contact is made with the depressed sensors 25, the movement of the patient support 30 will reverse upwards until the contact is removed. The sensors 22 could be designed to do the same, as well.

Figure 24:
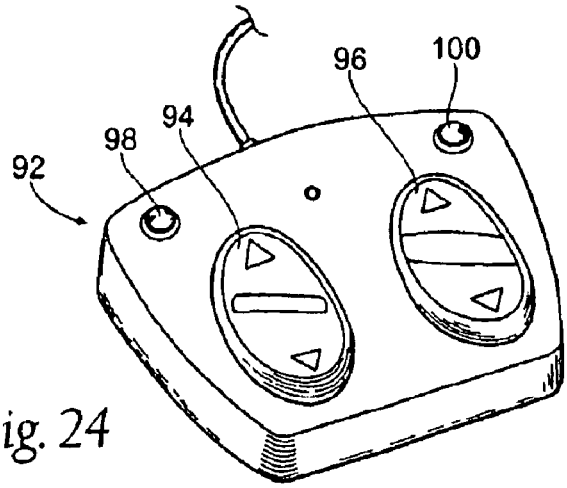
FIG. 24 is a perspective view of a control panel according to an exemplary embodiment.

Referring to FIG. 24, a perspective view of a control panel 92 is shown according to an exemplary embodiment. According to the embodiment shown, the control panel 92 is a foot-operated. Individual controls 94 and 96 can be used for up/down movement and inclined/declined movement, respectively. A single pedal may be used for a table that has manually operated backrest. The control panel 92 may also have an automatic reset switch 98 to move the patient support 30 to a retracted chair-like position, which can be considered the normal position for the table 10. An emergency stop switch 100 may also be located on the control panel 92 to stop all movement when activated. The control panel 92 is designed to simplify use of the table 10. According to various alternative embodiments, any of a number of control panels may be used to operate the table 10 including, but not limited to, controls provided on the structure of the table 10, hand-held controls, wireless controls, and/or any other suitable type of controls.

According to an exemplary embodiment, the table 10 is run with a low voltage electrical current, which provides a safer and more economical table than previous table designs. In one particular embodiment, the electrical current flowing through the actuators of the table is approximately 24 volts or less, which may reduce potential risks associated with higher voltage devices.

In operation, the patient support 30, and more specifically the patient support structure 32, of the table 10 is configured to move between different positions independent or separate of the first base 33 and any storage area coupled thereto or otherwise supported adjacent thereto. For example, the patient support structure 32 is configured to move between a substantially upright position and a substantially horizontal position in addition to moving between a lowered position and a raised position. This advantageously allows the top surface 72 to be used to place and store objects and instruments (e.g., see FIG. 3), even when the table 10 is acting as an examination bed. Further, as the patient support 30 or patient support structure 32 moves throughout the various positions, it does so without interfering with the rear storage section 70. This not only provides more freedom in the movement of the table 10, but does not compromise the potential storage area of the table 10. That is, the table 10 provides storage area in all positions, which makes the table more useful for the medical examiner.

It is also important to note that the construction and arrangement of the elements of the medical examination table 10 as shown in the exemplary embodiment is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements and those shown a multiple parts may be integrally formed. Accordingly, all such modifications are intended to be included within the scope of the present inventions. Other substitutions, modifications, changes and omissions may be made in the design, operating conditions and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the appended claims.

What is claimed is:

1. A medical examination table assembly comprising:

a base;

a patient support movable between a lowered position and a raised position, the patient support comprising a backrest and a seat; and a lift mechanism coupled to the base and the patient support for moving the patient support between the lowered position and the raised position, wherein the lift mechanism lifts the patient support while keeping a plane of the patient support substantially fixed through at least a portion of a range of movement of the patient support, wherein the base has a top surface, the seat being lower than the top surface when the patient support is in the lowered position.

2. The medical examination table assembly of claim 1, wherein the lift mechanism keeps the plane substantially parallel to a floor on which the base is resting through the portion of a range of movement of the patient support.

3. The medical examination table assembly of claim 1, wherein the backrest is movable relative to the seat between a substantially upright position and a substantially horizontal position.

4. The medical examination table assembly of claim 1, further comprising at least one support arm configured to move between a first support position and a second support position.

5. The medical examination table assembly of claim 4, wherein the at least one support arm rotates between the first position and the second position such that the second position is offset from the first position an angular distance greater than approximately 90 degrees.

6. The medical examination table assembly of claim 4, wherein the at least one support arm is movable to a third position which allows for patient transfer.

7. The medical examination table assembly of claim 1, wherein the base has a side surface and a storage area accessible from the side surface.

8. The medical examination table assembly of claim 7, wherein the storage area comprises at least one drawer accessible from the side surface.

9. The medical examination table assembly of claim 8, wherein the base has a first lateral side surface and an opposite second lateral side surface, the at least one drawer being accessible from both the first lateral side surface and the opposite second lateral side surface.

10. A medical examination table assembly comprising:

a base;

a patient support movable between a lowered and a raised position coupled to the base and including a backrest and a seat, the backrest being movable relative to the seat between a first position and a second position;

a storage unit configured to be coupled to the base, wherein the storage unit comprises at least one storage area accessible from at least two sides of the storage unit; and a lift mechanism coupled to the patient support for moving the patient support between a raised position and a lowered position, wherein a seating surface of the seat is at a wheelchair accessible height when the patient support is moved to the lowered position.

11. The medical examination table assembly of claim 10, wherein the backrest at least partially overlays the storage unit in the second position, wherein the second position is a substantially horizontal position.

12. The medical examination table assembly of claim 10, further comprising a drawer movable within the storage area.

13. The medical examination table assembly of claim 10, wherein the backrest of the patient support moves independent of the storage unit.

14. The medical examination table assembly of claim 12, wherein the drawer is configured as a pass-through drawer.

15. The medical examination table assembly of claim 14, wherein the drawer may be opened and closed when the backrest is in a substantially horizontal position.

16. The medical examination table assembly of claim 10, further comprising a lock that when coupled to the storage unit configures the storage area to be accessible from only one side of the storage unit.

17. A medical examination table assembly comprising:

a base;

a patient support movable between a lowered and a raised position coupled to the base and including a backrest and a seat, the backrest being movable relative to the seat between a first position and a second position;

a storage unit configured to be coupled to the base, wherein the storage unit comprises at least one storage area accessible from at least two sides of the storage unit; and a lock that when coupled to the storage unit configures the storage area to be accessible from only one side of the storage unit.

18. The medical examination table assembly of claim 17, wherein the backrest of the patient support moves independent of the storage unit.

19. The medical examination table assembly of claim 17, further comprising a drawer movable within the storage area, wherein the drawer is configured as a pass-through drawer.

20. The medical examination table assembly of claim 19, wherein the drawer may be opened and closed when the backrest is in a substantially horizontal position.

* * * * *